United States Patent [19]

Bihler et al.

[11] 4,333,593

[45] Jun. 8, 1982

[54] FEEDER FOR FEEDING STOCK TO MACHINES OR DEVICES

[75] Inventors: Otto Bihler, Schleiferweg 2, D-8959 Halblech, Füssen, Fed. Rep. of Germany; Eduard Brüller, Trimbach, Switzerland

[73] Assignee: Otto Bihler, Füssen, Fed. Rep. of Germany

[21] Appl. No.: 27,774

[22] Filed: Apr. 6, 1979

Related U.S. Application Data

[63] Continuation of Ser. No. 875,449, Feb. 6, 1978, abandoned.

[30] Foreign Application Priority Data

Feb. 15, 1977 [DE] Fed. Rep. of Germany ..... 2706351
Sep. 13, 1977 [DE] Fed. Rep. of Germany ..... 2741149

[51] Int. Cl.[3] ..... B65H 17/36
[52] U.S. Cl. ..... 226/122; 226/125; 226/142; 226/158; 226/162; 226/165
[58] Field of Search ..... 226/165, 162, 158, 159, 226/160, 120, 122, 125, 137, 139, 141, 142; 74/595, 596, 599, 600

[56] References Cited

U.S. PATENT DOCUMENTS

| | | | |
|---|---|---|---|
| 1,207,390 | 12/1916 | Frahm . | |
| 2,676,799 | 4/1954 | Fletcher . | |
| 3,242,768 | 3/1966 | Munschauer, Jr. | 226/142 X |
| 3,529,542 | 9/1970 | Rasenberger | 226/142 X |
| 3,690,533 | 9/1972 | Bihler | 226/165 |

FOREIGN PATENT DOCUMENTS

| | | |
|---|---|---|
| 538634 | 11/1931 | Fed. Rep. of Germany . |
| 2450970 | 5/1975 | Fed. Rep. of Germany . |
| 2613269 | 10/1976 | Fed. Rep. of Germany . |
| 152517 | 10/1920 | United Kingdom . |
| 677763 | 8/1952 | United Kingdom . |
| 1438261 | 6/1976 | United Kingdom . |

*Primary Examiner*—Stanley N. Gilreath
*Attorney, Agent, or Firm*—Toren, McGeady & Stanger

[57] ABSTRACT

In apparatus for feeding stock including a feeding slide driven for reciprocal motion within a linear path between two terminal positions by a crank mechanism, an auxiliary device is provided which periodically superimposes motion characteristics on the movement of the feeding slide caused by revolution of the crank mechanism at least in the regions of the terminal positions of the linear path of the feeding slide.

36 Claims, 19 Drawing Figures

FEEDER FOR FEEDING STOCK TO MACHINES OR DEVICES

This is a Continuation of Application Ser. No. 875,449 filed Feb. 6, 1978 now abandoned.

The invention relates to a feeding device for feeding stock to machines or devices, for example, of an automatic bending or punching machine having a feeding slide reciprocable in a straight line between two terminal positions and a drive arrangement for the feeding slide which includes an eccentric pin revolving eccentrically about an axis of revolution and leaving the feeding slide temporarily motionless in its two terminal positions during continued revolution of the eccentric pin.

A feeding device of this type is known from German patent document No. 2,033,940 (U.S. Pat. No. 3,690,533). In the known feeding device, the eccentric pin, whose eccentricity is adjustable, is connected with the feeding slide by a connecting rod so that the revolution of the eccentric pin is converted into a translatory movement of the feeding slide. The slide of the known feeding device pulls the material to be processed by the machine from a storage reel or the like and pushes it to the processing units of the machine during movement of the slide in one direction (feeding movement). The slide is provided for this purpose with controllable clamping members which clamp the material fast on the feeding slide at or immediately before the start of the feeding movement, and release the material at the end of the feeding movement after a retaining device has clamped the material fast to the stationary machine frame. The retaining device holds the material fast during the return movement of the feeding slide in order to prevent the material also to be moved back again by frictional engagement with the returning feeding slide. A cam disk arranged on the eccentric pin and revolving with the same actuates the clamping members of the feeding slide in the known feeding device by means of a separate rod. It is necessary for control of these clamping members that the feeding slide remain motionless for a certain stoppage time before the start and after the end of its feeding movement, that is, in its two terminal positions.

It is already known to achieve such stoppage of the feeding slide in its two terminal positions by connecting the connecting or coupling rod between the eccentric pin and the feeding slide with the latter by spring elements which permit a continued movement of the connecting rod in both terminal positions of the feeding slide after the feeding slide itself was stopped by engagement with respective abutments.

A rate time or cycle time of the machines under consideration may be defined as the period elapsing from the start of a feeding movement of the feeding slide to the period of the next consecutive feeding movement. During this rate time or cycle time, a length of material defined by the stroke of the feeding slide must be fed to and processed by the machine. As long as the material is moved by the feeding slide (feeding time), no processing can occur. Essentially, only the time during the return movement of the feeding slide (return time) and the afore-mentioned stoppage times of the feeding slide in its two terminal positions are available as working periods proper.

The eccentric pin of the feeding device is driven synchronously with the drive of the individual processing units for working the fed material, and generally by means of the same drive arrangement. The eccentric pin generally performs one full revolution about its axis of revolution during the period of one cycle. In the mentioned, known feeding device, the eccentric pin moves at a constant angular velocity in a circular path. Because of this constant angular velocity, the movement of the eccentric pin in an arc of 90°, for example, always takes ¼ of a cycle period whereas movement in an arc of 180° takes one half of the cycle period. If it be assumed for the sake of simplicity that the stoppage times are negligible, and that the feeding slide moves in the feeding direction during approximately 180° of the circumferential movement of the eccentric pin and is returned during the subsequent approximately 180°, just one half of the cycle period is available for processing the fed material. This may suffice for simple processing steps in the machine. If processing of the fed material is more complicated, the required working period is correspondingly longer. It is desired, therefore, to modify the ratio of the feeding time and the working time at constant cycle time in such a manner that the feeding time is shortened, and the working time lengthened. As indicated above, the stoppage times, that is, the periods during which the feeding slide is motionless in its terminal positions, are parts of the working time. A lengthening of the stoppage times at the expense of the feeding time thus causes the desired relative lengthening of the working time.

Such a lengthening of the stoppage times is possible in the known feeding device at constant stroke of the feeding slide and therefore at constant length of the material section fed during each cycle (feeding length) by increasing the eccentricity of the eccentric pin in combination with a correspondingly long deformation of the mentioned spring elements. These spring elements then have to absorb a greater portion of the pushing or pulling movement of the connecting rod during standstill of the feeding slide. This continued movement of the connecting rod absorbed by the spring elements while the feeding slide is arrested by an abutment will be referred to hereinafter as overrun.

However, the shortening of the feeding time or, with reference to the eccentric pin, of the feeding angle which is possible in the manner mentioned is associated with various disadvantages. Enlarging the eccentricity of the eccentric pin at unchanged rate of revolution defined by the machine causes a higher circumferential speed of the eccentric pin. This higher circumferential speed in turn causes more rapid movement of the feeding slide and thus a higher velocity of impact of the feeding slide on its abutments which define the length of feed. This higher velocity of impact reduces the precision with which the feeding length can be set by means of the abutments and increases wear. The higher velocity of impact furthermore causes more noise to be generated and requires more stable abutments because the kinetic energy of the feeding slide must be absorbed by the abutments practically without yielding for achieving uniformly precise feeding. Another disadvantage resulting from the indicated shortening of the feeding time results from the fact that at least those spring elements which transmits the feeding movement of the connecting rod to the feeding slide must be very rigid. This spring element must be stressed during the feeding movement only to such an extent that the desired deformation is still available at the end of the feeding movement for the stoppage time. Utilization of this deformation or overrun, however, requires energy greater than the substantial energy for the actual feeding process. The feeding device would consume substantially more energy when this possibility of shortening the feeding time is made use of. Moreover, rapid wear of the spring elements must be expected with such a modification at the high working speeds of modern machines.

If, in addition to feeding time, stoppage time, and return time, reference is made hereinafter to feeding angle, stoppage angle, and return angle, it is to be considered that there is a constant proportional relationship between the angle of revolution covered by the eccentric pin and the time required therefor when it be assumed that the angular velocity of the eccentric pin about its axis of revolution is constant. The feeding angle, for example, thus is the angle of revolution of the eccentric pin which is traveled by the pin during the feeding time. Correspondingly, the working angle is the angle in which the eccentric pin travels during the processing or working time defined above.

It is the object of the invention to modify a feeding device of the general type mentioned initially in such a manner that the feeding angle is shortened relative to the working angle, or the feeding time relative to the working time simultaneously with lower velocity of impact of the feeding slide on its abutments and small overrun.

This object is achieved according to the invention by an auxiliary device causing a component of movement of the feeding slide which is superimposed on the driven movement due to revolution of the eccentric pin at least within range of the terminal positions.

The desired movement of the feeding slide can be achieved by means of this auxiliary device without requiring spring elements permitting great deformation for absorbing the driven movement during the stoppage time of the feeding slide. The invention does not exclude the provision of the known spring elements in addition to and independently from the auxiliary device in order to absorb the overrun, that is, a continued drive movement, for example, of a connecting rod, after the feeding slide was stopped after engaging an abutment. Such an overrun may be useful for ensuring that the feeding slide actually engages the abutments in its two terminal positions and does not stop at a short distance from the same. The feeding length set by the abutments may be achieved precisely in this manner even when it is not desired to build the entire feed mechanism, and particularly the drive arrangement and the auxiliary device with such high precision as to make abutments unnecessary for achieving a very precise feeding length.

The supplemental component of movement must be adapted to the actual eccentricity of the eccentric pin for achieving optimal movement of the feeding slide. If this eccentricity is changed with simultaneous variation in the setting of the abutments for the feeding slide in order to produce a different feeding slide stroke and thus a different feeding length of the material to be fed, it would be necessary also to modify the supplemental component of movement. However, if a small overrun is provided and absorbed by the aforementioned spring elements, the need for adjusting the component of movement for each small change in the eccentricity of the eccentric pin is avoided. This overrun can be very small in the apparatus of the invention and is substantially independent from the magnitude of the feeding angle because the latter is determined primarily by the superposition of the rotary movement of the eccentric pin and the component of movement derived from the auxiliary device. At constant eccentricity and constant supplemental component of movement, a change in the feeding angle, of course, also causes a change in the overrun. Because the overrun to be absorbed by the spring elements according to the invention is small, the eccentricity of the eccentric pin may be chosen almost equal to one half the feeding length, that is, one half the stroke of the feeding slide which causes engagement of the feeding slide with its abutments at a substantially lower velocity, as will be explained later in more detail. Ultimately, the auxiliary device permits varying the feeding length by changing the eccentricity of the eccentric pin and the spacing between the abutments for the eccentric pin corresponding to desired values without significantly affecting the other parameters such as feeding angle and the overrun to be absorbed by the spring elements.

In one embodiment of the invention, the auxiliary device consists of a cam disk arranged on the eccentric pin and revolving with the same about the axis of revolution of the latter. A cam follower roller rolls along the circumference of the cam disk and is fastened, for example, on the head of a connecting rod whose eye is connected to the feeding slide. If the cam disk is circular in a limiting case, the locus of the curve of movement of the center of the cam follower roller is also a circle in first approximation. The connecting rod connected with the cam follower rollers would perform the same movement in this case as in the known feeding device in which the head of the connecting rod is set directly on the eccentric pin. When the cam disk deviates from a circular shape, there is obtained a locus of a curve of movement for the center of the cam follower roller which deviates from a circular shape, and therewith a different movement of the connecting rod and of the coupled feeding slide. The movement of the connecting rod may be considered due to superimposition of a drive movement derived from the eccentric pin and of a component of movement determined by the cam disk.

In an advantageous embodiment of the invention, the head of the connecting rod is elongated in the direction of the rod axis and receives a slide member in an axially extending recess, the slide member being arranged on the eccentric pin for rotation about the axis of the latter. Being guided by the slide member, the connecting rod is enabled to shift relative to the eccentric pin in accordance with the shape of the cam disk.

The cam follower roller is pressed into contact with the circumference of the cam disk by means of a biasing device to ensure that the cam follower roller actually follows the cam disk. For this purpose, a tension or compression spring may be effective, for example, between the slide member and the connecting rod. The biasing device is preferably arranged in such a manner as to become effective during the return movement of the feeding slide because the force is then smaller than during the forward movement.

If the cam disk is constituted by a so-called constant diameter disk, as is not necessary, but possible, the rod head may have two follower rollers which enclose the recess in the rod head therebetween and are arranged spaced and engage diametrically opposite sides of the cam disk. Manufacturing tolerances may be compensated in this case as well by fastening one of the cam follower rollers resiliently on the rod head for movement along the line connecting the centers of both cam follower rollers. This resilient mounting of the cam follower rollers which primarily serves for compensating manufacturing tolerances with two cam follower rollers or for achieving conforming engagement with one cam follower roller could be relied upon in the event particularly of small feeding lengths or small feeding variations for the purpose of absorbing residual overrun so that resiliency in the coupling element between the eccentric pin and the feeding slide or other motion transmitting elements may be dispensed with.

According to another feature of the invention, an eccentric slide carrying the eccentric pin is adjustable in a manner known in itself along a diameter of a drive disk capable of being driven suitably by the machine drive. According to the invention, the cam disk is provided with a bore for passage of the eccentric disk and fixedly fastened to the eccentric slide whereas the slide member is located on the side of the cam disk directed away from the eccentric slide. The cam disk preferably has a shape similar to that of a triangle whose circumferential sections consist of sinuids.

In the afore-described embodiment of the invention, the coupling member connecting the eccentric pin and the feeding slide, such as a connecting rod, is set on the eccentric pin of the drive arrangement in such a manner that it is shifted relative thereto during one revolution of the eccentric pin in accordance with the shape of the cam disk.

The superposition of the angular movement of the eccentric pin and of the component of movement derived from the cam disk corresponds in its effect to a periodic adjustment of the eccentricity of the eccentric pin effective for the coupling element. The same effect is achieved in another embodiment of the invention by the auxiliary device cyclially varying the spacing of the eccentric pin from its axis of revolution, that is, the actual eccentricity. However, alternatively, the auxiliary device may constitute a part of a coupling arrangement between the eccentric pin and the feeding slide and cyclically vary the spacing between the eccentric pin and a point of engagement of the coupling device at the feeding slide. If the coupling device is constituted by a connecting rod hinged to the eccentric pin, the auxiliary device may connect, for example, this connecting rod with the feeding slide.

The auxiliary device in the last mentioned embodiments of the invention may include one or more hydraulically of pneumatically operable working cylinders which are actuated cyclically in response to the angular position of the eccentric pin. The working cylinder or cylinders may be controlled mechanically or electrically. Ultimately, the auxiliary device may include, instead of one or several working cylinders, another kind of drive, for example, an electric drive which produces the desired supplemental component of movement.

Provisions are made in another embodiment of the invention for the auxiliary device to include a second eccentric pin which revolves at a higher rate of revolution than the first eccentric pin, but synchronously with the latter, about a second axis of revolution.

By means of the second eccentric pin, a curve of displacement for the feeding slide is achieved in a very simple manner, the displacement being composed of a main component of movement originating in the first eccentric pin, and a supplemental conponent of movement originating in the second eccentric pin. As will be discussed in detail with reference to FIGS. 9–18, the resulting displacement curve permits the choice of a relatively small feeding angle. A small feeding angle is equivalent at constant circumferential speed of the eccentric pin with a short feeding time.

The eccentricities of the first and/or second eccentric pin are preferably adjustable in order to permit selection of the optimum displacement curve depending on the desired feeding length for the material to be processed.

The superposition of the principal component of movement and the supplemental component of movement again may be achieved in the most diverse ways. In a part of the embodiments of the invention described hereinafter, the first eccentric pin is eccentrically arranged on a disk, and this disk is journaled rotatably in an element reciprocated by the second eccentric disk in the direction of movement of the feeding slide. This element may be, for example, a kind of rocker, the axis of rotation of the disk moving back and forth in a circular arc, or a slide shifting the axis of rotation of the disk in a straight line. In another embodiment of the invention provisions are made for the second eccentric pin itself to carry the disk, being preferably constituted by an eccentric bushing in which a drive shaft carrying the disk is journaled. In a further embodiment of the invention, the two eccentric pins are arranged separately. The principal component of movement and the supplemental component of movement are superimposed on each other at a lever which is hingedly secured to the feeding slide and is also connected with the two eccentric pins by push rods.

The resulting curve of displacement has a particularly advantageous course if the frequency of the supplemental component is three times that of the principal component of movement. This is achieved in the last-mentioned embodiments of the invention when the second eccentric pin revolves at three times the number of revolutions of the first eccentric pin.

The principal component of movement and the supplemental component of movement may also be superposed in an additional embodiment of the invention in such a manner that the first eccentric pin itself carries the second eccentric pin so that the central axis of the first eccentric pin becomes the axis of revolution of the second. The second eccentric pin, for this purpose, is preferably constituted by an eccentric bushing slipped over the first eccentric pin. If two eccentric bushings, fitted one in the other, are employed instead of a single eccentric bushing, the eccentricity of these two "eccentric pins" may be adjusted by relative angular movement of the two eccentric bushings. The revolution of the two eccentric bushings about the first eccentric pin can be derived in a simple manner in this embodiment from the circumferential movement of the eccentric pin. The second eccentric pin including its drive may be built in this manner as a structural unit which may also be installed later in existing eccentric drives of feeding devices.

Further advantages and features of the present invention will become evident from the following description of embodiments having reference to the appended schematic drawings in which:

FIG. 1 schematically illustrates a known feeding device;

FIG. 2*a* is a displacement diagram for explaining the availability of a feeding angle reduction in the feeding device of FIG. 1;

FIG. 2*b* is a velocity diagram corresponding to the displacement diagram of FIG. 2*a;*

Figure 7:
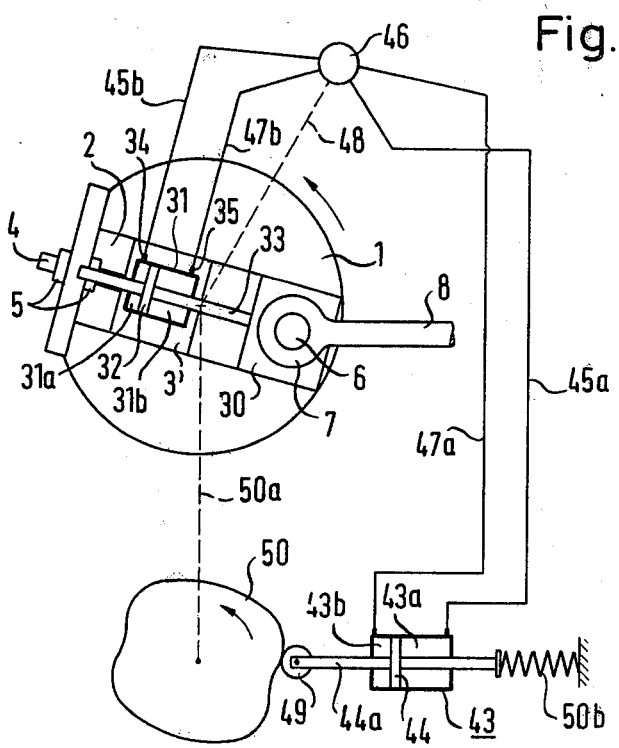
Figure 8:
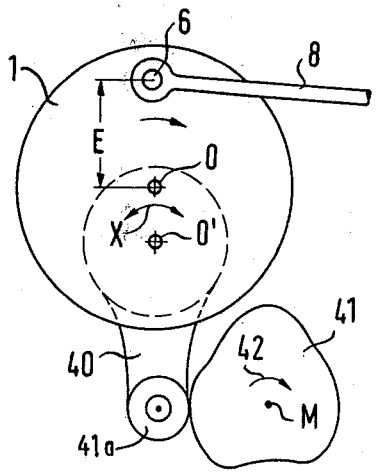
Figure 9:
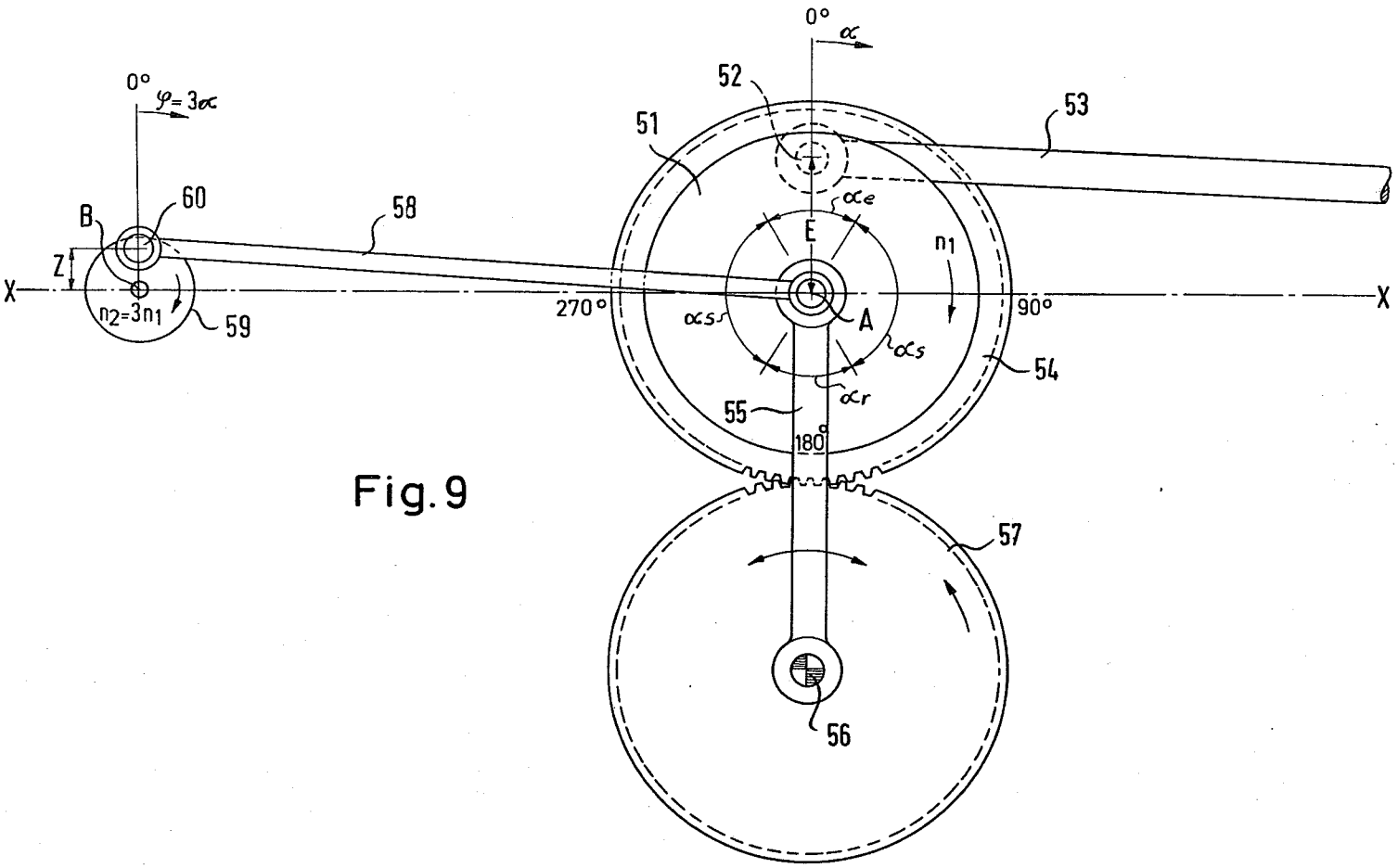
Figure 10:
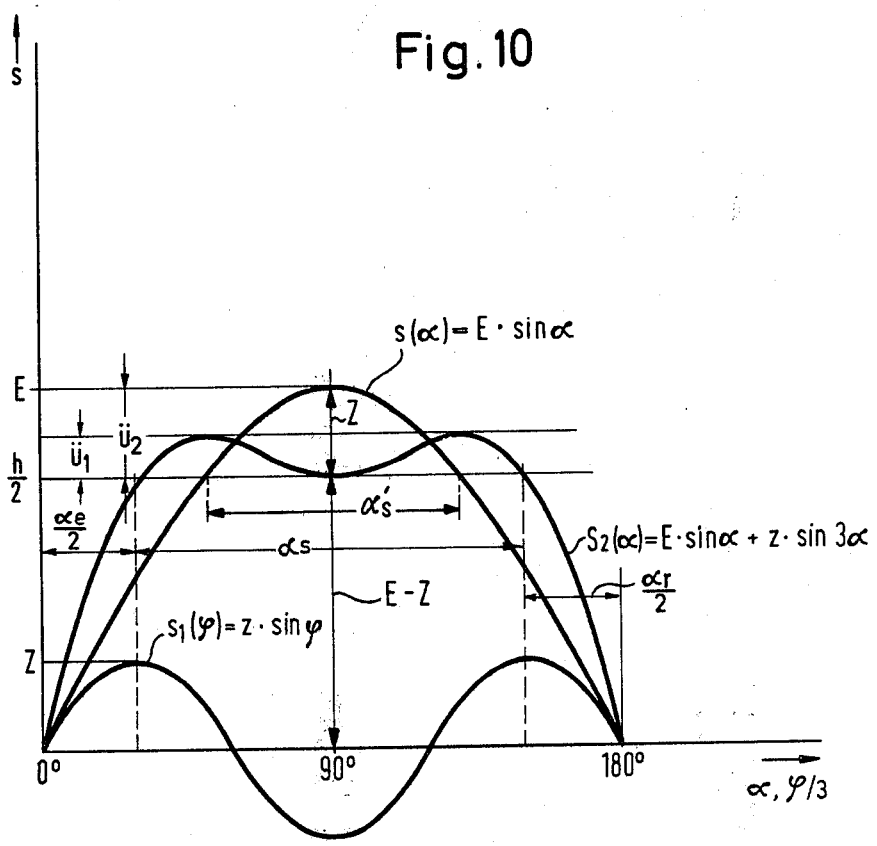
Figure 11:
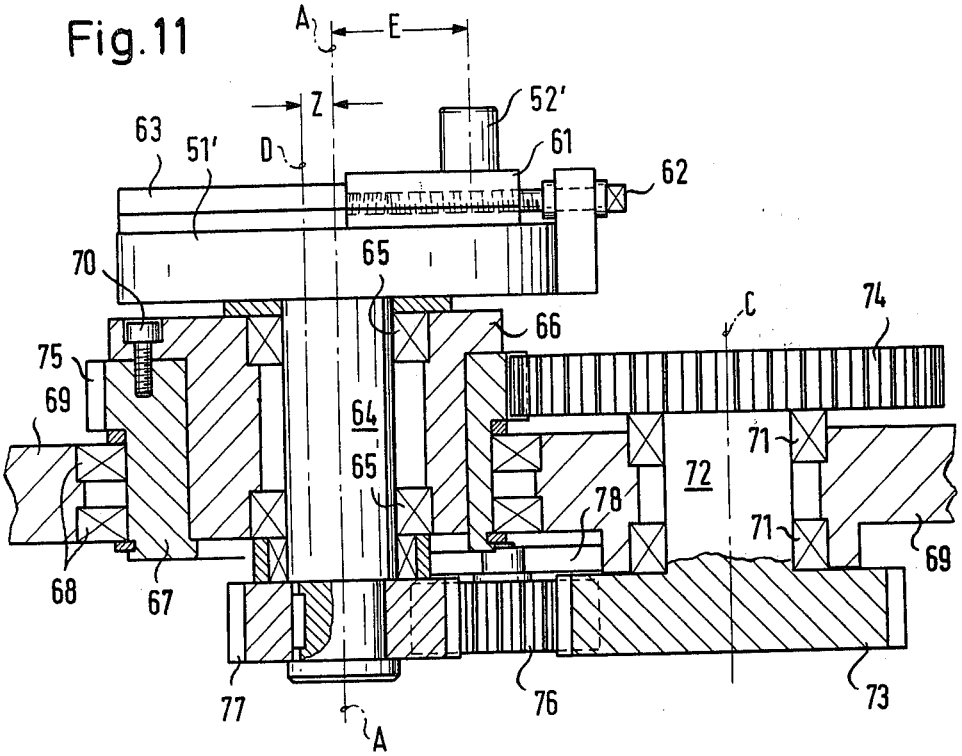
Figure 12:
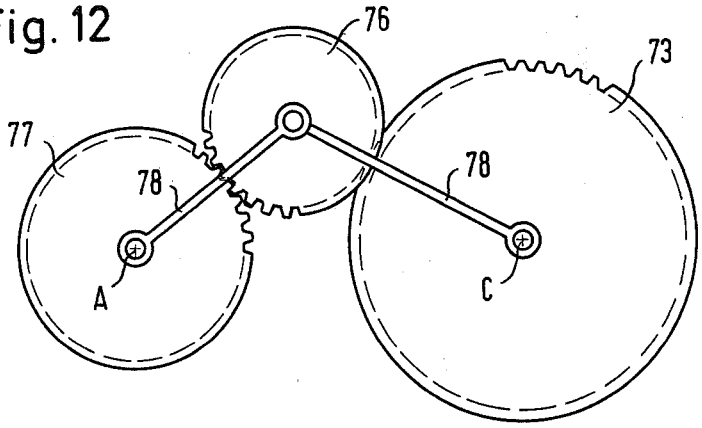
Figure 13:
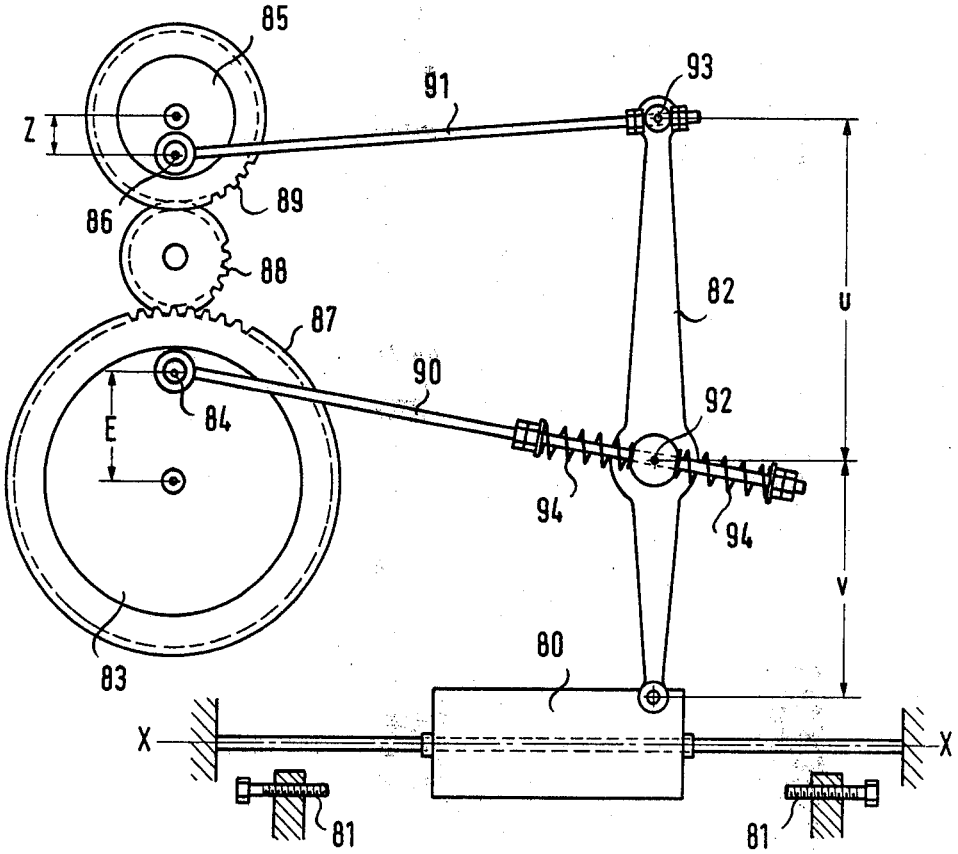
Figure 14:
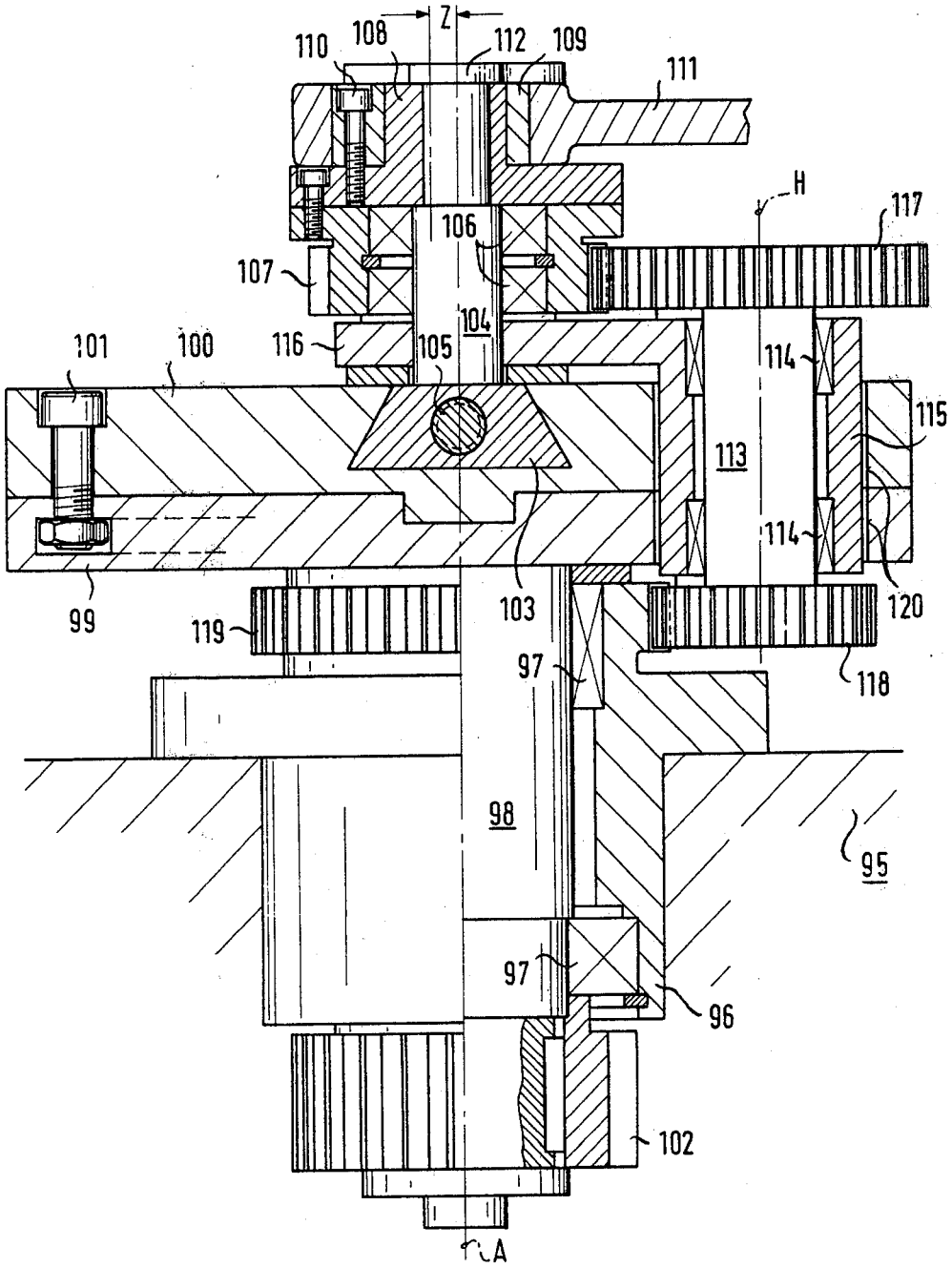
Figure 15:
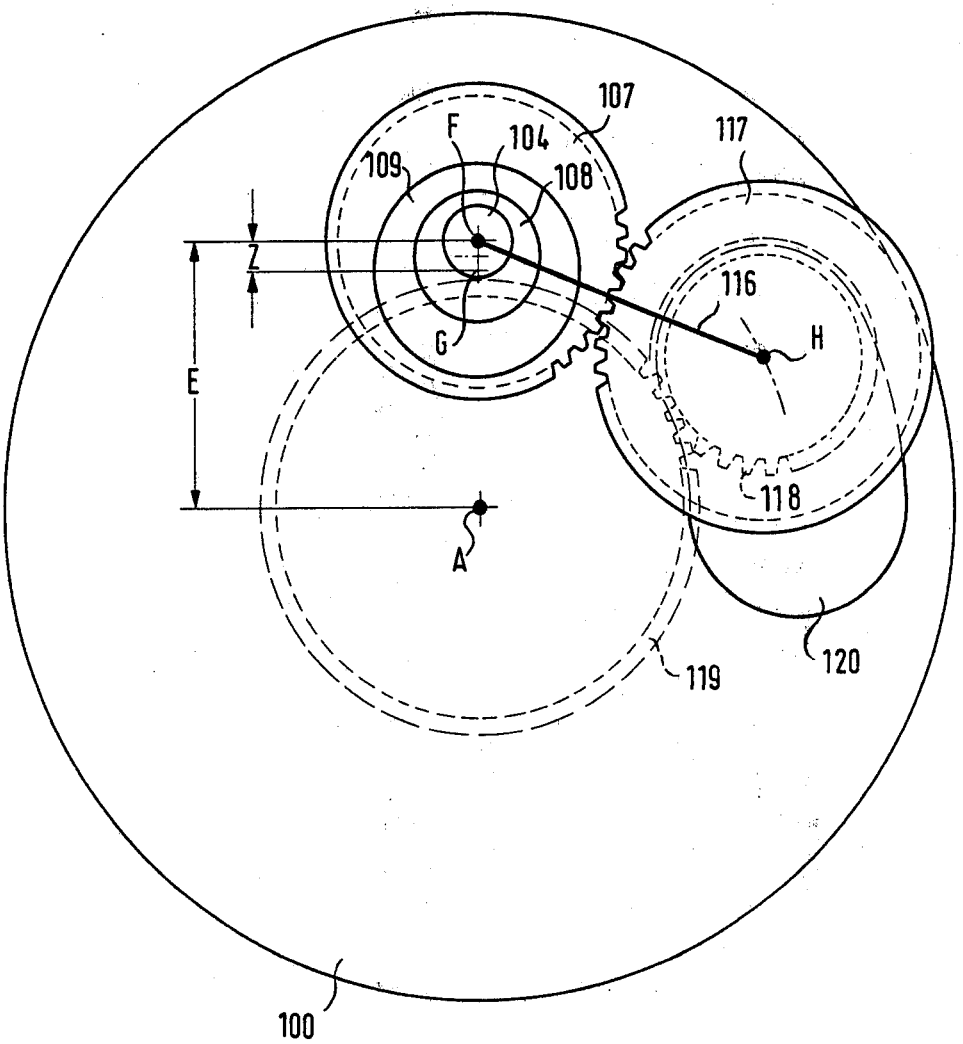
Figure 16:
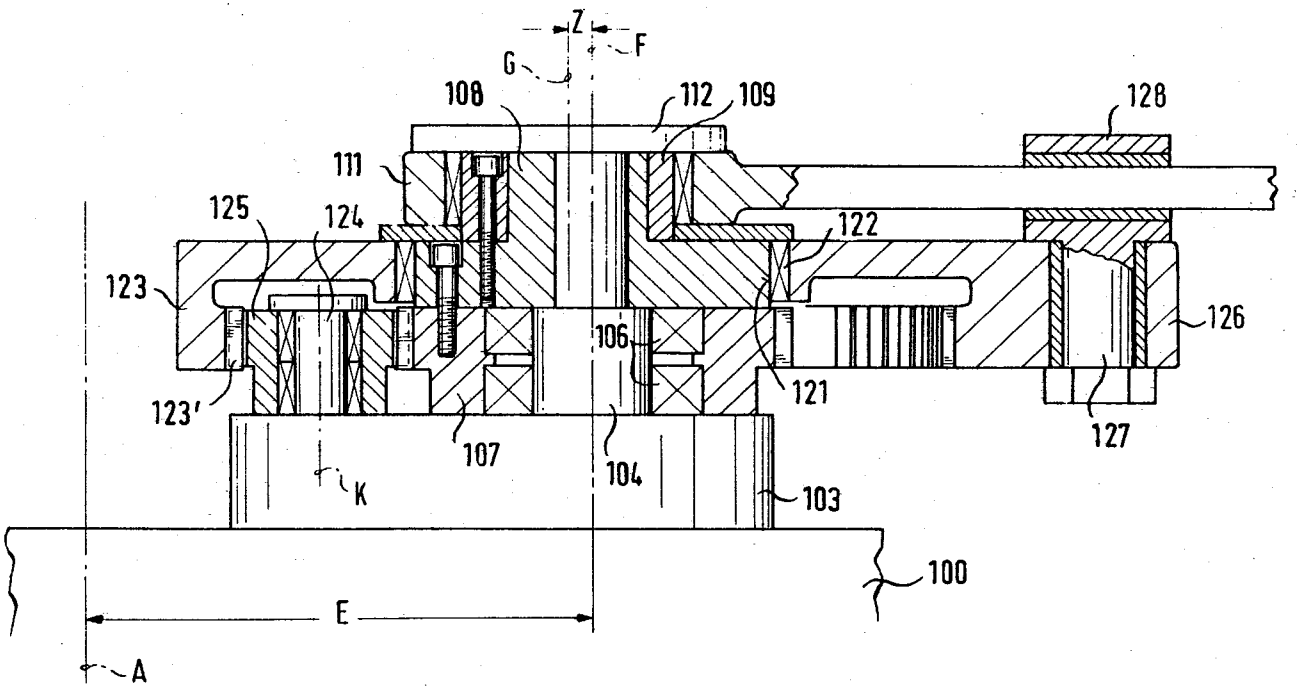
Figure 17:
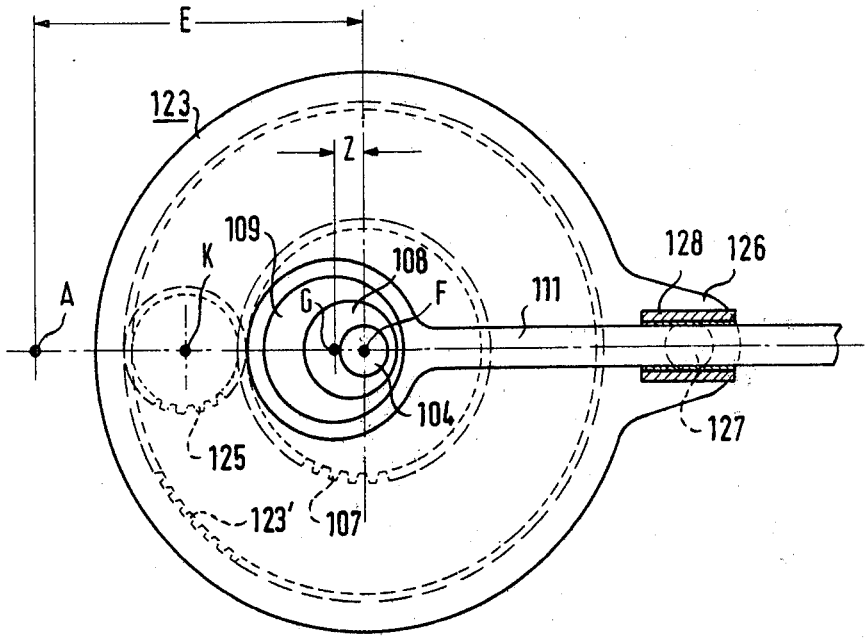

FIGS. 7 and 8 schematically illustrate a second and a third embodiment of the invention;

FIG. 9 is a schematic side view which shows a fourth embodiment of the invention;

FIG. 10 illustrates the two components of movement and the resulting displacement curve applicable to the fourth and all subsequent embodiments;

FIG. 11 shows a fifth embodiment of the invention in side-elevational section;

FIG. 12 illustrates the position of the gears in the embodiment of FIG. 11 in top plan view;

FIG. 13 is a schematic side view which shows a sixth embodiment of the invention;

FIG. 14 shows a seventh embodiment of the invention in side-elevational section;

FIG. 15 is a top plan view of the embodiment of FIG. 14;

FIG. 16 illustrates an eighth embodiment of the invention in side elevational section;

FIG. 17 is a top plan view of the embodiment of FIG. 16; and

Figure 18:
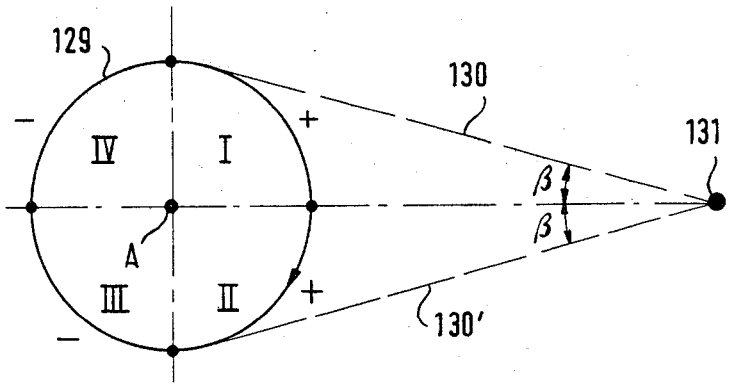

FIG. 18 is an illustration explaining a periodically variable circumferential velocity of the first eccentric pin which may occur in the embodiments of FIGS. 16 and 17.

Figure 1:
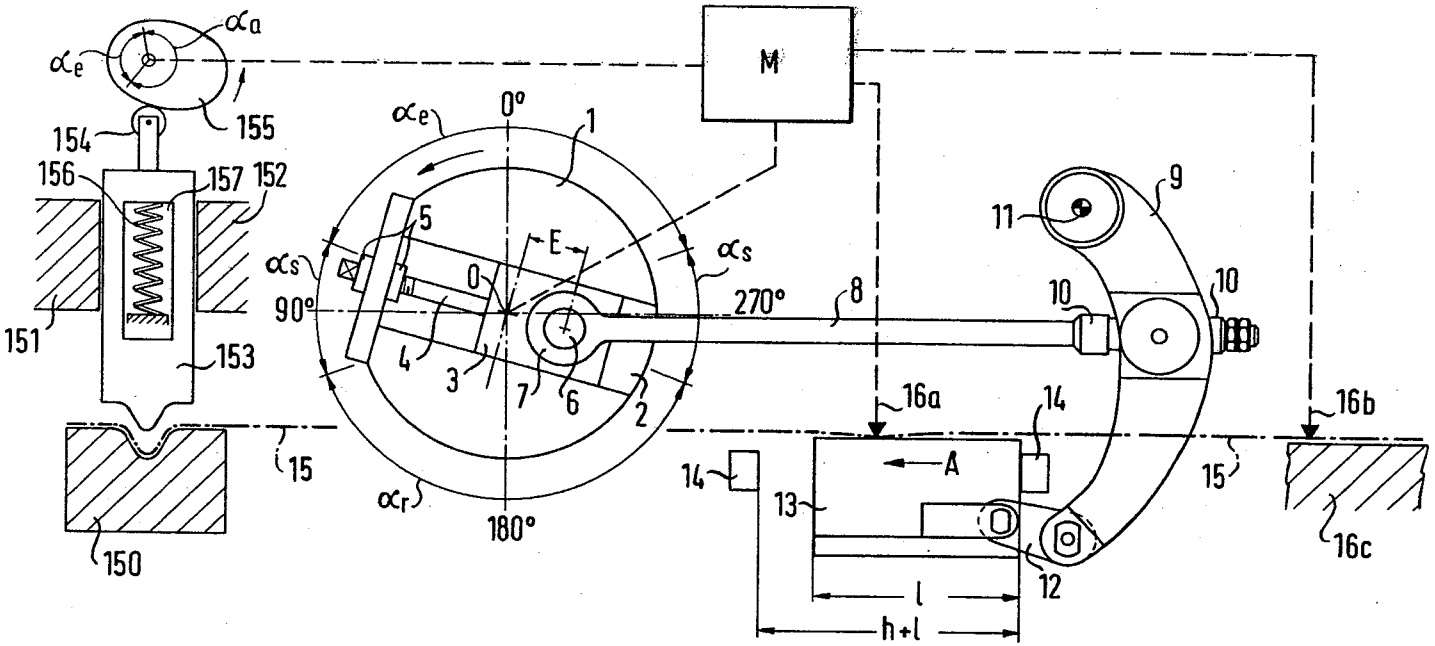
Fig.1 PRIOR ART

In FIG. 1, a disk 1 is driven for rotation about the axis 0 by the machine drive indicated at M. The disk 1 performs one revolution at constant angular velocity during one cycle time of the machine. An eccentric slide 3 is adjustable along a guideway 2 in or on the disk 1. The position of the eccentric slide 3 may be varied by means of a spindle 4 and nuts 5. An eccentric pin 6 on which the head 7 of a connecting or pull rod 8 is set is located on the eccentric slide 3. The eye of the connecting rod is operatively connected to a lever 9 by springs 10. The lever is mounted for pivotal movement about a shaft 11 fixedly mounted on the machine frame in a suitable manner. The end of the lever 9 remote from the shaft 11 is connected with a feeding slide 13 by a link 12. The slide 13 may be shifted along a rectilinear path between two abutments 14. The stroke h of the feeding slide 13 depends on its length 1 and the spacing of the two abutments 14.

When the disk 1 turns, the eccentric pin 6 moves in a circular path about the axis of rotation 0. The connecting rod 8 is shifted thereby in the direction of its longitudinal axis and pivoted about the center of its eye. The magnitude of the axial shifting depends on the adjustable eccentricity E of the eccentric pin 6 whereas the magnitude of the pivoting movement is smaller with increasing length of the connecting rod 8 relative to the eccentricity E.

In the following explanations of FIGS. 2*a*, 2*b*, 3, 6, and 10, it will be assumed for the sake of simplicity that the length of the connecting rod 8 is so great as compared to the eccentricity E of the eccentric pin 6 that the pivoting movement of the connecting rod may be neglected. The connecting rod thus moves almost parallel to itself. It is to be noted that the applicability of the invention is not impaired in any manner by this simplification merely serving for explanation of principles. The invention to be described later is thus usable at any imaginable ratio of connecting rod length to eccentricity, and is further not limited, of course, to a connecting rod as a coupling member between the eccentric pin and the feeding slide. Such coupling may occur, for example, also and particularly at small feed lengths, by the eccentric pin directly entraining a slide member guided in a groove of the feeding slide transversely to the direction of feeding movement. The translatory movement of the connecting rod 8 in FIG. 1 causes turning of the lever 9 about the shaft 11. This turning of the lever shifts the feeding slide 13 by means of the link 12. The connecting rod 8 could also act directly on the feeding slide 13 without the modifying lever 9.

The feeding device illustrated in FIG. 1 is intended for feeding tape or wire shaped material, designated 15, in sections of the same feeding length from a non-illustrated storage reel or the like to the machine in the direction of the arrow A. The feeding length is readily evident from FIG. 1 to be equal to the stroke h of the feeding slide. It can be set for a desired value by varying the spacing of the two abutments 14. Tongs schematically indicated by the arrow 16*a* clamp the material fast to the feeding slide 13 during the feeding movement of the feeding slide which is assumed arbitrarily in FIG. 1 to be the movement from the right abutment 14 to the left abutment 14 so that the material is moved to the left jointly with the slide. When the feeding slide 13 impinges on the left abutment 14 in FIG. 1 during this feeding movement, its movement is stopped while the eccentric pin 6 continues moving at constant speed of revolution and one of the springs 10 absorbs the also continuing movement of the connecting rod 8 until the eccentric pin has passed the dead center position at the left in FIG. 1 (90° point). During this standstill period, a retaining element constituted by tongs schematically represented by an arrow 16*b* engages the material 15 and clamps it to a stationary frame portion of the machine, indicated at 16*c*. Only after the material is clamped fast to the stationary frame portion, the tongs 16*a* release the material. The material 15 is prevented thereby from being pulled back from the machine partly or entirely by friction of the feeding slide 13 during the subsequent return movement of the feeding slide. the feeding slide 13 is pulled back again to the abutment 14 at the right of FIG. 1 after the end of the stoppage period to remain arrested again at this abutment for the duration of a certain stoppage period. Clamping of the material by the tongs 16*b* to the stationary frame portion 16*c* is again relaxed during this second stoppage period, however, only after the tongs 16*a* again clamped the material to the feeding slide 13. The change-over between the activity of the tongs 16*a* and 16*b* thus always occurs with an overlap.

A processing unit in the form of a bending tool which is to work the material 15 is schematically illustrated at the left in FIG. 1. The bending tool includes a die 150 and a punch 153 movable in a straight line between two stationary guides 151, 152. The die 150 is formed with a recess corresponding to the desired bend whereas the lower end of the punch 153 has a shape complementary to the recess. The opposite end of the punch 153 carries a cam follower roller 154 which engages a cam disk 155. A common machine drive M synchronously drives the disk 1 as well as the cam disk 155 at the same rotary speed. The afore-described control of the tongs 16a and the retaining element 16b may also be derived from the drive M as indicated by broken-line connections with the drive M. The punch 153 is biased by a spring 156 (upward as shown in FIG. 1). The spring 156 is housed in a recess 157 of the punch 153 and its lower end engages a stationary element, the upper end the punch 153.

As long as the eccentric pin is within its feeding angle $\alpha_e$, the cam follower roller 154 engages the part of the cam disk 155 which has the smallest radius. The punch 153 thus is retracted so far from the die 150 that the next section of the material 15 may be pushed between the die 150 and punch 153. Depending on the shape of the die and punch, it may be necessary for unimpeded feeding of the material 15 that the die 150 be retracted from its working position to a rest position during the feeding movement of the feeding slide. This movement of the die 150 may occur in exactly the same manner as with the punch 153 by means of a cam disk and a return spring. A revolution of the cam disk 155 defines a machine cycle which includes the feeding of the material and the movement of the punch 153, and optionally of the die 150, from the rest position into the working position and back into the rest position It is to be noted that several processing units may act on the previously fed length of material within this machine cycle simultaneously or sequentially if more complicated bending and/or punching operations are to be performed.

Figure 2A:
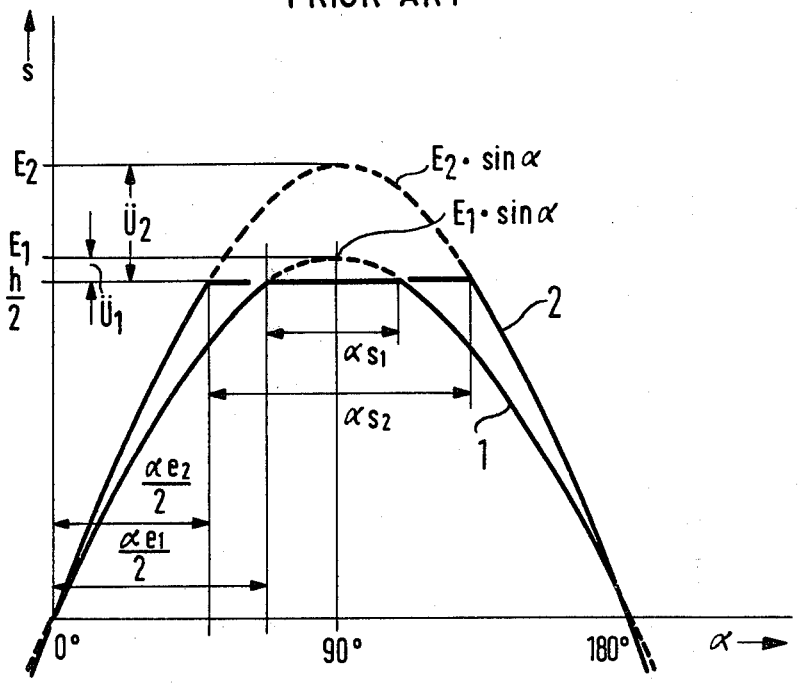
Fig. 2a PRIOR ART

FIG. 2a shows two different displacement diagrams for the feeding device of FIG. 1, that is, diagrams of the paths traveled by the feeding slide 13 during the angle of revolution $\alpha$ traveled by the eccentric pin 6. The terms feeding angle $\alpha_e$, stoppage angle $\alpha_s$ and return angle $\alpha_r$ (see FIG. 1) with respect to the movement of the feeding slide 13 correspond to the previously defined terms feeding time, stoppage time, and return time which refer to movement of the feeding slide as defined before. As long as the angular velocity of the eccentric pin is constant, the angles are proportional to the corresponding times. The condition in which the feeding slide 13 is centered between the two abutments 14 will be defined arbitrarily as s=O for the purpose of the explanation. The displacement from the center to the left abutment in FIG. 1 will be termed arbitrarily to be positive, and the displacement from the center to the right abutment in FIG. 1 as negative.

Making the simplifying assumption explained hereinabove that the inclination of the connecting rod 8 during a revolution of the eccentric pin 6 may be neglected, the feeding movement of the feeding slide 13 after release from the right abutment 14 in FIG. 1 follows the curve $E_1 \cdot \sin \alpha$ if the eccentricity E of the eccentric pin 6 equals $E_1$, and the curve $E_2 \cdot \sin \alpha$ in the case of the eccentricity $E=E_2$, $\alpha$ being the angle of revolution of the eccentric pin 6 about the axis of rotation 0. When the feeding slide thereafter impinges on the left abutment 14 in FIG. 1, the eccentric pin just finishes moving through the feeding angle $\alpha_e=\alpha_{e1}$ or $\alpha_e=\alpha_{e2}$ (see also FIG. 1). Because the range of angles of revolution of the eccentric pin 6 is illustrated in FIG. 2a only between 0° and 180°, there is shown only one half of each feeding angle $(\alpha_{e1})/2$ or $(\alpha_{e2})/2$. As long as the eccentric pin 6 thereafter passes through the stoppage angle $\alpha_s=\alpha_{s1}$ or $\alpha_s=\alpha_{s2}$ (at the left in FIG. 1), the feeding slide 13 stands at the left abutment 14 and does not move, the corresponding displacement curves (1) or (2) in FIG. 2a are in this stage rectilinear and parallel to the abscissa. After the eccentric pin 6 has passed the stoppage angle $\alpha_s$, the feeding slide 13 is pulled back to the right abutment 14 during the return angle $\alpha_r$. In view of the generally symmetrical conditions, the feeding angle $\alpha_e$ is equal to the return angle $\alpha_r$. The displacement curves (1) or (2) now again follow the functions $s=E_1 \cdot \sin \alpha$ or $s=E_2 \cdot \sin \alpha$.

The material is moving only as long as the feeding slide 13 moves while the tongs 16a simultaneously clamp the material 15 to the feeding slide 13 so that working or processing of the material cannot take place. This happens while the eccentric pin 6 travels through the feeding angle $\alpha_e$. The working angle $\alpha_a$ available for working or processing the fed material thus is $$\alpha_a=\alpha_r+2\cdot\alpha_s=360°-\alpha_e \text{ because}$$

$$\alpha_r+\alpha_e+2\times\alpha_s=360°.$$

A comparison of the displacement curves (1) and (2) in FIG. 2a shows a possibility of shortening the feeding angle $\alpha_e$ and thereby enlarging the working angle $\alpha_a$ in the feeding device illustrated in FIG. 1. When the eccentricity of the eccentric pin 6 is increased from $E=E_1$ to $E=E_2$, the movement of the feeding slide 13 outside the stoppage angle or stoppage times occurs according to the function $s=E_2 \cdot \sin \alpha$. As can be seen in FIG. 2a, the feeding angle $\alpha_{e2}$ which must be passed by the eccentric pin 6 for moving the feeding slide 13 from the right abutment 14 to the left abutment 14 in FIG. 1 is smaller at the greater eccentricity $E_2$ than in the case of the eccentricity $E_1$. No further explanation is needed that this smaller feeding angle $\alpha_{e2}$ brings about a correspondingly greater working angle $\alpha_a$. It is simultaneously evident from FIG. 2a that the overrun $\ddot{u}_2$ of the connecting rod 6 which must be absorbed by the spring 10 after the feeding slide impinges on an abutment 14 is very much greater in the case of the curve (2) than the comparable overrun $\ddot{u}_1$ with the curve (1). The deformation of the springs 10, therefore, must be correspondingly greater which causes the above-mentioned disadvantages as to quicker wear and higher energy consumption.

Figure 2B:
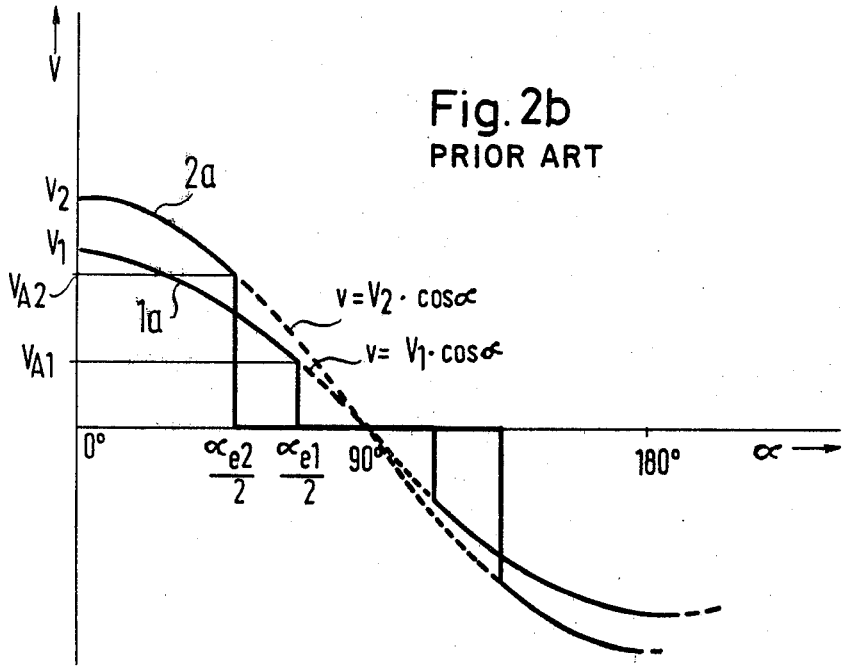
Fig. 2b PRIOR ART

The velocity v of the feeding slide as a function of the angle of revolution $\alpha$ of the eccentric pin 6 is shown in FIG. 2b in accordance with the two displacement curves (1) and (2) in FIG. 2a. No further explanation is needed that the velocity of the feeding slide follows a cosine course as long as the slide is not stopped forcibly by an abutment. The velocity of the feeding slide 13 at the end of the feeding angle $\alpha_{e1}$ or $\alpha_{e2}$ is the impingement velocity $V_{A1}$ or $V_{A2}$ at which the feeding slide impinges on its abutments 14. It is evident from FIG. 2b that the impingement velocity $V_{A1}$ is substantially lower than the impingement velocity $V_{A2}$. One reason for this is to be found in the cosine-shaped course of the velocity of the feeding slide which causes the impingement velocity to approach the maximum velocity ever closer with decreasing feeding angle. A second reason for $V_{A2}$ being greater than $V_{A1}$ is the increased eccentricity $E_2$ which causes a greater circumferential velocity of the eccentric pin 6, and thereby a greater maximum velocity $V_2$ of the feeding slide 13 at equal rotary speed of the disk 1.

It is found that the feeding angle $\alpha_e$ can be decreased in the known feeding device according to FIG. 1 by changing the eccentricity E of the eccentric pin 6 and by a corresponding change of the springs 10, but that this decrease is bound to a strong increase of the overrun and of the impingement velocity. Because both a great overrun and a great impinging velocity are disadvantageous, narrow limits are set to the decrease of the feeding angle in the known feeding device.

Figure 3:
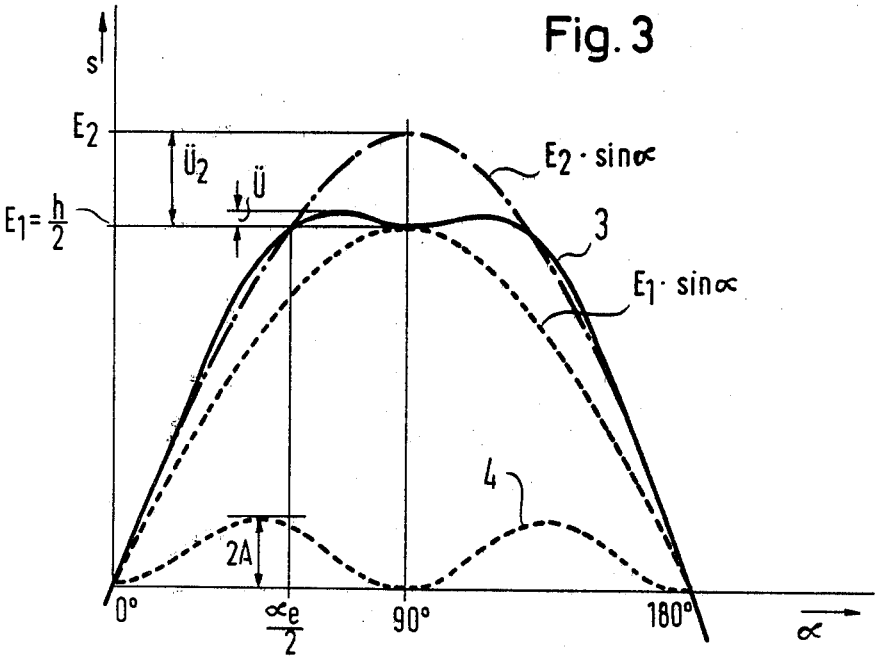
FIG. 3 is a displacement diagram of the feeding device according to the invention.

The theoretical base for the solution provided by the invention for the problem of feeding-angle reduction will be explained now with reference to FIG. 3. FIG. 3 again contains various displacement curves, that is, relationships of displacement and angle of revolution. The curves $E_1 \cdot \sin \alpha$ and $E_2 \cdot \sin \alpha$ correspond to the equally labeled curves in FIG. 2*a* and merely serve for comparison. The curve (3) represents the movement of the feeding slide achieved according to the invention. The curve (3) results from the superposition or addition of the curve (4) to the curve $E_1 \cdot \sin \alpha$. If the eccentricity E in FIG. 1 were set exactly to one half h/2 of the stroke of the feeding slide 13, the feeding slide would follow a movement corresponding to $E_1 \cdot \sin \alpha$ without showing noticeable stoppage times. According to the invention, the feeding slide is subjected to a component of movement corresponding to the curve (4) in FIG. 3 by means of an auxiliary device to be described in detail later. Because of this component of movement, the feeding slide traverses the feeding slide stroke h or the feeding length already at a very small angle of revolution of the eccentric pin; that is, at a feeding angle $\alpha_e$ which may correspond to the feeding angle $\alpha_{e2}$ of FIG. 2*a*. Yet, this small feeding angle is associated with an overrun ü very much smaller than the overrun $ü_2$ and also with a very much smaller impingement velocity. It can be seen directly from the course of the curve (3) in FIG. 3 that the impingement velocity during movement of the feeding slide according to the curve (3) in FIG. 3 is smaller than with a movement corresponding to the function $E_2 \cdot \sin \alpha$. This fact, however, is also capable of easy mathematical proof. If, only by way of example, the course of the displacement curve (4) for achieving the supplemental component of movement is assumed to be $$s_{(4)} = A.[\cos(4\alpha - \pi) + 1]$$

wherein A is merely any desired proportionality constant, there results for the displacement curve (3)

$$s_{(3)} = E_1 \cdot \sin \alpha + A. \cos(4\alpha - \pi) + 1$$

The associated course of the velocity $(ds_{(3)}/(dt)$ is obtained by differentiating this equation for the curve (3) with respect to $\alpha$, because $\alpha$ is proportional to time at constant rate of revolution of the eccentric pin. Such differentiation leads to the following result:

$$v \sim E_1 \cdot \cos \alpha - 4A \cdot \sin(4\alpha - \pi)$$

The two terms of the preceding equation for v have opposite signs over the range $45° \leqq \alpha \leqq 90°$ so that the resulting velocity v in this range is even smaller than the portion thereof originating from the function $E_1 \cdot \sin \alpha$ alone. With the function for the displacement curve (4) chosen by way of example, a reduction in the impingement velocity as compared to both displacement curves (1) and (2) of FIG. 2*a* is possible if the feeding angle is in the range between 90° and 180°.

It is to be noted at this point that the displacement curve (4) shown in FIG. 3 must become negative in the range $180° < \alpha < 360°$ in the same manner as the sine function. The example of the cosine function assumed above for the displacement curve (4) is valid therefore only in the range $0° < \alpha < 180°$.

It is seen from FIG. 3 that almost any desired displacement curve for the feeding slide may be obtained by selection of the displacement curve (4) for achieving a supplemental component of movement. It is seen simultaneously that the advantages of a superposition of components of movement according to the invention apply also if the inclination of the connecting rod is not disregarded, thus when the length of the connecting rod is not very much greater than the eccentricity E. When this inclination of the connecting rod 8 is taken into consideration, there is obtained a displacement curve deviating from the function $E_1 \cdot \sin \alpha$, but which may lead to the same shape of curve or a similar one as represented by the displacement curve (3) in FIG. 3 by superposition of a correspondingly selected displacement curve (4).

If the eccentricity of the eccentric pin is enlarged or reduced in a feeding device built according to the invention because a greater or smaller feeding length is required, this variation of the eccentricity is possible in a certain range without having to change the component of movement generated by the auxiliary device corresponding to the displacement curve (4) in FIG. 3. If one were to start from the conditions according to FIG. 3 and select an eccentricity of $E > E_1$ in connection with a greater stroke h of the feeding slide, the displacement curve (3) would be flatter in the area of the stoppage angle, and the overrun ü would become smaller. The opposite effect would occur when h is reduced and $E < E_1$. Only when the overrun ü approaches zero in the first case or becomes excessive in the latter case would it be necessary to adapt the course of the displacement curve (4) to the altered course of the basic displacement curve.

Figure 4:
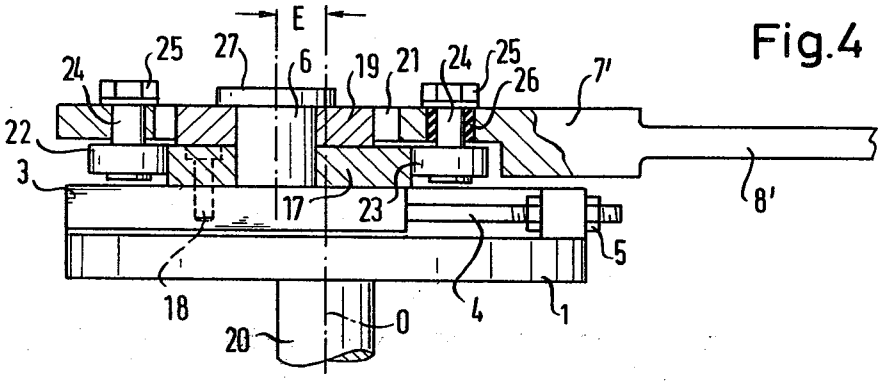
FIG. 4 is a fragmentary, side elevation, partly in section, of a first embodiment of the feeding device according to the invention for achieving the displacement diagram shown in FIG. 3.
Figure 5:
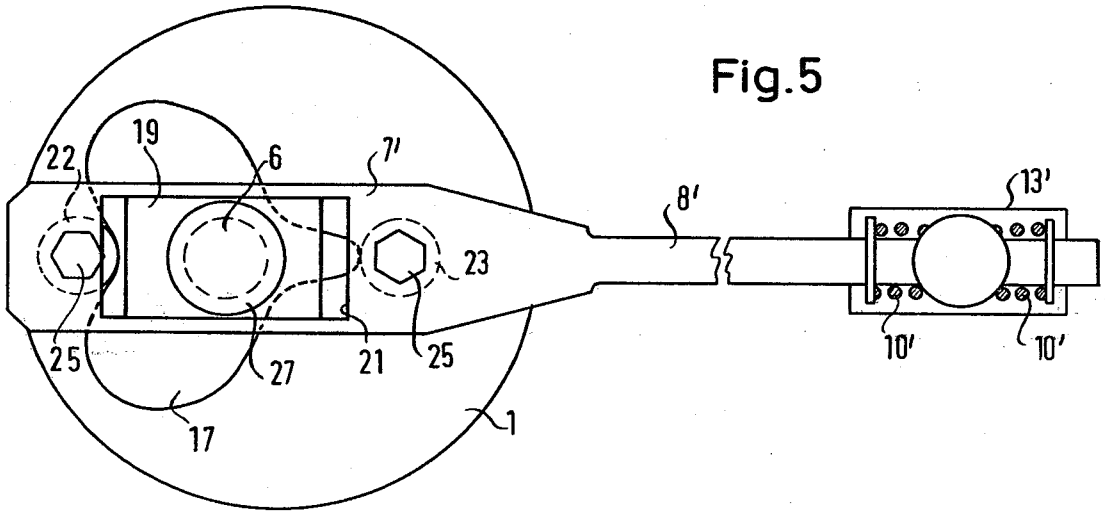
FIG. 5 is a top plan view of the feeding device according to FIG. 4.

FIGS. 4 and 5 schematically show an embodiment of the invention in which a supplemental component of movement is superposed on the drive motion by the rotation of an eccentric pin in order to achieve a movement of the feeding slide corresponding to the displacement curve (3). Those elements of the purely schematic FIGS. 4 and 5 which correspond to elements of FIG. 1 are designated by the same reference numerals. Again an eccentric slide 3 is arranged on a disk 1 rotating synchronously with the drive of the processing units of the machine and is guided adjustably on the disk 1 by means of a spindle 4 or the like and nuts 5 or the like as already explained with reference to FIG. 1. The eccentric slide 3 carries the eccentric pin 6 whose eccentricity E depends from the position of the eccentric slide 3 and is therefore variable. A cam disk 17 is on the eccentric slide, is secured against rotation on the eccentric slide 3 by means of a screw 18 or the like, and has an opening for passage of the eccentric pin 6. A rectangular slide member 19 is located above the cam disk 17 on the eccentric pin 6 and is rotatable about the central axis of the latter. The disk 1 is connected with a suitable drive by a shaft 20 and performs one revolution per cycle time of the machine.

A connecting rod 8' is coupled by springs 10' (FIG. 5) with the feeding slide 13' not shown in FIG. 4. The connecting rod 8' has an elongated head 7' at its end directed toward the eccentric pin 6. The head 7' has a rectangular opening 21 in which the slide member 19 is received. The connecting rod 8' can turn about the central axis of the eccentric pin 6 because of the engagement of slide member 19 and opening 21 and can simultaneously shift longitudinally relative to the eccentric pin 6. Cam follower or contact rollers 22, 23 are fastened rotatably on respective sides of the opening 21 on the head 7' in such a manner that they can ride on the circumference of the cam disk 17. The contact rollers are fastened to the head 7' by means of suitable bolts 24 and screws 25 or otherwise. The illustrated and described arrangement of two contact rollers 22, 23 presupposes that the cam disk 17 is a so-called constant diameter disk, that is, that the spacing of the cam disk between the two contact rollers remains substantially constant. One of the contact rollers is fastened resiliently to the connecting rod head 7' for compensation of manufacturing tolerances which are not entirely avoidable by means of a rubber sleeve 26 so that the spacing of the two contact rollers 22, 23 is variable, but that they are also held safely in constant engagement with the cam disk 17. Preferably, the contact roller controlling the return movement of the feeding slide which transmits the forward run, that is, the feeding movement to the feeding slide is rigidly mounted on the connecting rod head 7'. Only one contact roller may be provided instead of the illustrated two contact rollers and biased into engagement with the circumferential face of the cam disk 17 by means of spring (not shown) acting between the head 7' and the slide member 19 or the eccentric pin 6. The contact roller and the spring are preferably arranged in this case too in such a manner that power is transmitted during the feeding movement of the feeding slide by the contact roller. A disk or head 27 of the eccentric pin prevents the slide member 19 from slipping off the eccentric pin 6.

Figure 6:
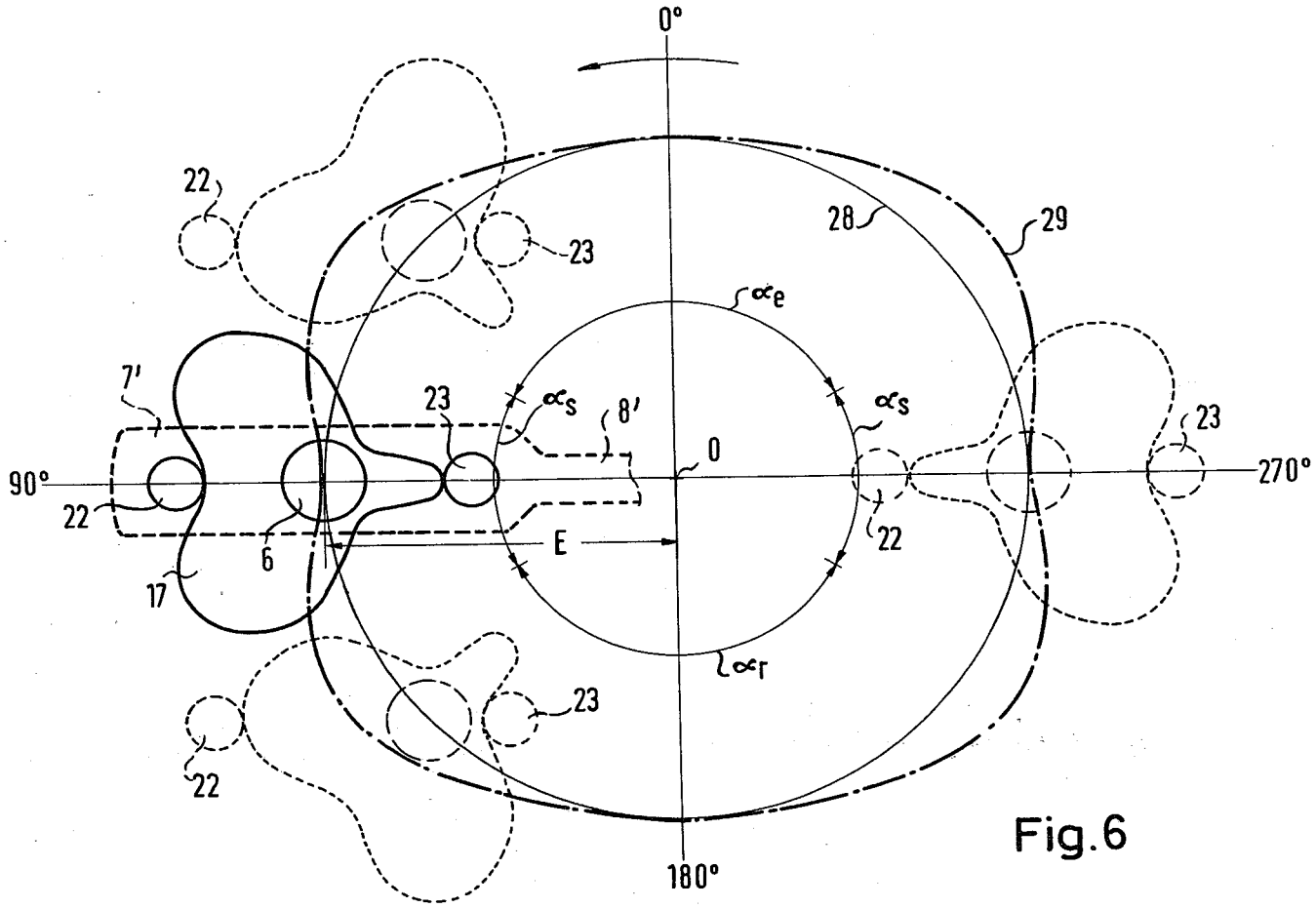
FIG. 6 is a schematic illustrating the mode of operation of the device shown in FIGS. 4 and 5.

The mode of operation of the feeding device schematically shown in FIGS. 4 and 5 will now be explained with reference to FIG. 6. FIG. 6 shows the cam disk 17 and eccentric pin 6 in various positions. The non-illustrated feeding slide is assumed to be located to the right of FIG. 6. It is operatively connected with the cam disk 17 by the connecting rod 8' and its head 7', as well as the contact rollers 22, 23. The inclination of the connecting rod 8' during a revolution of the eccentric pin 6 is again to be neglected for simplifying the explanation, and thus to be assumed that the connecting rod 8' is parallel to the 90°/270° line in all positions of the eccentric pin 6.

The curve which is the locus of the center of the eccentric pin 6 during a full revolution is represented in FIG. 6 by the circle 28. The cam disk 17 is shaped so that the point of the head 7' coinciding with the center between the contact rollers 22, 23 moves in the path 29 which deviates from the circle 28. The diametrically opposite points of the circumference of the cam disk 17 are equidistant from the center of the eccentric pin 6 in the 0°, 90°, 180°, and 270° positions of the eccentric pin so that the mentioned reference point of the head 7' coincides with the center of the eccentric pin. However, the reference point of the head 7' is shifted relative to the center of the eccentric pin 6 toward the left (in FIG. 6) in the positions between 0° and 90° and between 90° and 180°, while it is shifted toward the right in the ranges between 180° and 270° and betwen 270° and 0°. The operation of the cam disk 17 corresponds in its effect, therefore, to a seeming enlargement of the eccentricity E in the afore-mentioned ranges of angle of revolution of the eccentric pin. If the abscissa of the locus curve 29 parallel to the 90°/270° line is entered in developed representation over the angle $\alpha$ of revolution of the eccentric pin, there is obtained a curve corresponding to the displacement curve (3) of FIG. 3. The difference of the abscissas between the locus curve 29 and the circle 28, when linearily entered over the angle of revolution, leads to a curve corresponding to the displacement curve (4). This difference depends on the shape of the cam disk 17 by means of which, therefore, the displacement curve of the feeding slide may be set in more or less any shape whatsoever.

In FIG. 6, the feeding angle $\alpha_e$, the stoppage angle $\alpha_s$, and the return angle $\alpha_r$ are again represented, and it may be seen directly from FIG. 6 that the displacement of the connecting rod 8' and thus of the non-illustrated feeding slide is great in the range of the feeding angle and the return angle, but small in the range of the stoppage angles.

If another supplemental component of movement should be required because of a change in the feeding length h and an associated change in the eccentricity E of the eccentric pin 6, the cam disk 17 may be replaced by a correspondingly differently shaped disk with a few manipulative steps. The influence of the inclination of the connecting rod occurring at any finite rod length and neglected in the preceding discussion is readily compensated by the shape of the cam disk 17.

In constructing such a cam disk 17, one may start from a showing according to FIG. 3 in which a desired displacement curve (3) is set, and the necessary displacement curve (4) is determined by subtracting the sine function whose ordinate at $\alpha=90°$ is equal to the ordinate of the set displacement curve. The desired shape of the cam disk 17 results from translation of the supplemental displacement curve (4) into polar coordinates. However, it is to be noted that the shape of the transition parts of the cam disk is determinative of smooth running and thereby contributes to the output of the machine. These transition parts, must be designed and executed with particular care. Sudden changes in the velocity (of the movement transmitted to the connecting rod 8') which mean shocks are to be avoided. For this purpose, the several curved pieces of the displacement time diagram or displacement angle-of-revolution diagram must merge tangentially (without break). Sudden occurrence or abrupt change of acceleration causes increased inertial forces which may act like shocks (deflection of the cam disk). They may be avoided by having the individual branches of the velocity time curve (velocity angle-of-revolution curve) merge tangentially. An optimum solution can be achieved by basing the individual transition pieces of the desired curve shape for the acceleration curve on a sine line. A cosine line is derived therefrom for the velocity curve, and a higher sinuid for the displacement curve. It is an advantage of this higher sinuid as displacement curve that the acceleration and velocity at the start and end of each transition piece become zero.

When the cam disk 17 is to be a constant diameter disk, the cam must be designed in sections, sinuid-shaped or not, and the diametrically opposite cam section must be given the complementary shape necessary for achieving the constant-diameter property.

Superposition of a supplemental component of movement on the drive movement for a feeding slide resulting from the revolution of an eccentric pin is not limited to the use of a cam disk 17 as an auxiliary device producing the supplemental component of movement. The locus curve 29 of the central reference point of the connecting rod head 7' may also be achieved, for example, by actual, periodic variation of the eccentricity E of the eccentric pin 6. The rod head, in this case, need not be movable longitudinally relative to the eccentric pin, but need only be rotatable as in the known feeding device of FIG. 1. The periodic change in the eccentricity of the eccentric pin 6 may be achieved, for example, by means of the device schematically shown in FIG. 7.

The elements corresponding to FIG. 1 are again designated in FIG. 7 by the same reference numerals. A showing of the feeding slide and of its coupling with the connecting rod 8 was omitted. This coupling may be made as in FIG. 1, for example. Contrary to FIG. 1, an eccentric slide 3' and an auxiliary slide 30 are movably guided in the guideway 2 of the disk 1 in the feeding device of FIG. 7. The position of the eccentric slide 3' is again adjustable by means of a spindle 4 or the like and screws 5 or the like. The eccentric slide 3' carries a working cylinder 31 whose piston 32 is connected with the auxiliary slide 30 by a piston rod 33. The working cylinder 31 is indicated to be a double-acting cylinder having two pressure-medium connectors 34, 35. Depending on the connector of the cylinder being supplied with pressure medium, the piston 32 can be shifted relative to the cylinder 31 and thus to the eccentric slide 3'. A shifting of the piston 32 results in a corresponding shifting of the auxiliary slide 30 relative to the disk 1. A basic eccentricity corresponding, for example, to the radius of the circle 28 in FIG. 6 may be set by the position of the eccentric slide 3'. The auxiliary slide 30 with the eccentric pin 6 may be adjusted periodically during a complete revolution of the disk 1 by suitably controlling the working cylinder 31 so that the center of the eccentric pin 6 defines a locus curve deviating from the circular shape according to the curve 29 in FIG. 6. The effects of the embodiments of FIGS. 4 and 5 and of FIG. 7 would then be identical.

The working cylinder 31 of FIG. 7 may be controlled by the working cylinder 43. Whereas the piston 32 of the working cylinder 31 divides the same into two compartments 31*a*, 31*b*, a piston 44 divides the working cylinder 43 into two compartments 43*a*, 43*b*. The compartment 43*a* is connected with the compartment 31*a* of the working cylinder 31 by pressure-medium line 45*a*, a rotary pressure-medium distributor 46, and a pressure-medium line 45*b*. The compartment 43*b* is correspondingly connected with the compartment 31*b* by a pressure-medium line 47*a*, the rotary pressure-medium distributor 46, and a pressure-medium line 47*b*. The pressure-medium distributor is arranged coaxially with the disk 1 and provides communication between the pressure-medium lines 45*b*, 47*b* rotating with the disk 1 and the associated stationary pressure-medium lines 45*a*, 47*a*. The rotating part of the pressure-medium distributor 46 is connected fixedly with the disk 1 or a common drive shaft (not shown), as indicated by the broken line 48. One end of the piston rod 44*a* projecting from the working cylinder 43 carries a cam follower roller 49 which engages a cam disk 50. The cam disk 50 rotates synchronously with the disk 1 and at the same rotary speed as the disk 1 with the illustrated shape of the cam disk. This drive of the cam disk 50 is indicated by the broken line 50*a*. It may be realized, for example, by arranging the cam disk 50 coaxially with the disk 1 on a common drive shaft. A return spring 50*b* is interposed between the other end of the piston rod 44*a* and a stationary frame portion only hinted at in FIG. 7 and biases the piston rod 44*a* so that the cam follower roller 49 permanently engages the cam disk 50. In the working cylinder 31, as well as in the working cylinder 43, the respective piston rods extend entirely through both compartments 31*a*, 31*b* or 43*a*, 43*b* whereby the combined volume of both compartments of the respective working cylinders remains constant independently of the positions of the pistons 32, 44.

The compartments of the working cylinders 31, 43 and the pressure-medium connections between these compartments are filled with pressure medium. If the cam disk 50 turns because of the common drive simultaneously with a revolution of the disk 1, the piston rod 44*a* together with the piston 44 is shifted in the working cylinder 43 because of the engagement of the cam follower roller 49 with the cam disk 50. If the volume of the compartment 43*b* is reduced because of the direction of this shifting movement, and the volume of the compartment 43*a* is increased, there results a corresponding increase in the volume of the compartment 31*b* and a reduction in the volume of the compartment 31*a* which causes a shifting of the piston 32 jointly with the piston rod 33. As explained, a shifting of the piston rod 33 causes a change in the eccentricity of the eccentric pin 6, in the assumed case, a reduction of this eccentricity. Depending on the shape of the cam disk 50, the eccentricity of the eccentric pin 6 may be varied periodically in this manner, and a supplemental movement superposed on the revolution of the eccentric pin 6. It is possible with the device only schematically illustrated in FIG. 7 to have the center of the eccentric pin 6 and thereby the center of the connecting-rod head 7 to traverse a locus curve corresponding to the locus curve 29 of FIG. 6.

The working cylinder 31 of FIG. 7 may also be controlled by valves which connect the pressure-medium connectors 34, 35 with a suitable source of pressure medium. The non-illustrated valves may be actuated themselves electronically or mechanically, for example, also by means of cam disks, in such a manner as to result in the desired variation of the eccentricity, that is, the spacing of the center of the eccentric pin 6 from the center of the disk 1. The variation in the eccentricity of the eccentric pin 6 may also be controlled periodically by means of a drive other than the working cylinder 31 illustrated in FIG. 7, for example, by means of an electric motor.

Instead of the double-acting working cylinder 31, a single-acting working cylinder combined with a biasing device may be provided in the embodiment according to FIG. 7. Additionally, it is possible to connect the working cylinder directly with the disk 1 and to adjust the basic eccentricity of the eccentric pin 6 also by means of the working cylinder 31 according to the desired feeding length.

The supplemental component of movement may be superposed on the basic movement originating in the revolution of the eccentric pin in a different place than described so far. For example, the length of the connecting rod connecting the eccentric pin with the feeding slide or a lever according to claim 1 may be varied periodically. It is also possible to vary periodically the transmission ratio for the drive movement of the feeding slide by means of the lever 9 shown in FIG. 1 in order to introduce the supplemental component of movement according to the invention. The auxiliary device which produces this supplemental component of movement, may also be in this case a pneumatic or hydraulic pressure-medium drive, an electric drive, or the like.

The supplemental component of movement may also be produced at the connecting point between the connecting rod and the feeding slide. Because the maximum inclination of the connecting rod depends from the set eccentricity of the eccentric pin, the supplemental movement could be made dependent from this inclination of the connecting rod and thereby from the set eccentricity, for example, by means of a suitable cam disk or another control element. The supplemental component of movement would be adapted automatically in this manner to the set eccentricity.

Another possible embodiment of the invention is schematically illustrated in FIG. 8. The drive disk 1 is journaled for rotation about the axis O in a rocker lever 40. The rocker lever 40 itself is rotatable about a stationary axis O' offset from the axis O and has a cam follower roller 41*a* at its lower end. A cam disk 41 is rotatable about an axis M and rotates synchronously with the drive disk 1. The shape of the cam disk 41 depends on the ratio of its rotary speed to that of the drive disk 1. The eccentric pin 6 of preferably adjustable eccentricity E is fastened to the drive disk 1 in the manner described with reference to the preceding embodiments and is connected, by way of example, by the connecting rod 8 with a non-illustrated feeding slide. A turning of the cam disk 41 in the direction of the arrow 42 causes the axis of rotation O of the drive disk 1 to pivot periodically in the direction of the double arrow X about the pivot axis O' of the rocker lever 40. This pivoting or tilting movement of the drive disk 1 is superimposed in the connecting rod 8 on the movement caused by the eccentric 6. It is understandable that the shape of the cam disk 41 may be designed in accordance with the afore-mentioned ratio of rotary speeds in such a manner that the desired course of movement of the feeding slide results, for example, according to the curve (3) in FIG. 3. The drive disk 1 is driven in a suitable manner so that it performs one revolution per cycle time of the machine.

FIG. 9 shows a fourth embodiment of the feeding device of the invention in purely schematic representation. A disk 51 rotates synchronously with the drive of the non-illustrated machine which is to work or process the material to be fed. One revolution of the disk 51 corresponds to a complete cycle time of the machine. The disk 51 carries an eccentric pin 52 which is spaced at the eccentricity E from the center or axis of rotation A of the disk 51. The eccentric pin 52 is operatively connected by means of a coupling member, exemplified by an illustrated connecting rod 53, with a non-illustrated feeding slide corresponding, for example, to that shown in FIG. 1, which is guided along the axis X—X. The eccentric pin 52 may alternatively engage directly a guide groove formed in the feeding slide and perpendicular to the direction of slide movement. The eccentricity E of the eccentric pin 52 may be adjustable according to FIG. 1 for adjusting the stroke of the slide. The disk 51 as well as a spur gear 54 connected or unitary therewith are rotatable freely on the free end of a rocker 55. The other end of the rocker 55 is freely pivoted in a stationary joint 56. Another spur gear 57 is supported concentrically with the axis of the joint 56 and is driven in a suitable manner so that the disk 51 rotates synchronously in the manner described with the machine drive, considering the transmission ratio of the spur gears 54, 57, and performs one rotation per cycle time. A push rod 58 is pivoted to the free end of the rocker 55. However, the point of engagement of the push rod 58 with the rocker 55 need not necessarily coincide with the bearing of the disk 51 and the spur gear 54 but may be anywhere between the joint 56 and the free end. A second disk 59 is mounted for rotation about an axis B of rotation and is driven in a suitable manner synchronously with the disk 51, but at three times the rotary speed $n_2=3n_1$. The second disk 59 carries a second eccentric pin 60 at an eccentricity Z on which the other end of the push rod 58 is pivotally mounted, and whose eccentricity may be adjustable in a manner similar to that of the eccentric pin 52.

If the disk 59 turns about the axis B in the arrangement shown in FIG. 9, the axis A with the disk 51 reciprocates in a circular arc concentric with the joint 56. Furthermore, when the disk 51 turns about the axis A, the connecting rod 53 moves the non-illustrated feeding slide in a straight line back and forth on the axis X-X between two terminal positions. If it is assumed again for the sake of simplicity that the length of the connecting rod 53 is great as compared to the eccentricity E of the first eccentric pin 52, the rotation of the disk 51, while the disk 59 is stationary, would result in the displacement curve illustrated in FIG. 10 $s(\alpha)=E\cdot\sin\alpha$ wherein s is the path traveled by the feeding slide from the central position and $\alpha$ is the instantaneous angle of rotation of the disk 51 according to the definition in FIG. 9. The displacement curve is shown in FIG. 10 only for the angular range $0°\leqq\alpha\leqq180°$. It is clear that the maximum stroke of the feeding slide in the case of the simplifying assumption equals twice the amplitude of the displacement curve $s(\alpha)$, namely 2E.

If it be assumed for further simplification that the lengths of the rocker 55 and of the push rod 58 are great compared to the eccentricity Z of the second eccentric pin 60, there is obtained substantially the displacement curve $s_1(\phi)=Z\cdot\sin\phi$ for a movement of the axis A of the disk 51 along the axis X-X during rotation of the disk 59, wherein $s_1$ is the path traveled by the axis A in the direction of the axis X-X from a central position, and $\phi$ the angle of revolution of the disk 59 defined in FIG. 9.

The displacement curve $s_2(\alpha)$ for the feeding slide actually resulting from the action of the auxiliary drive 59, 60 is obtained by superimposition, that is, addition of the displacement curves $s(\alpha)$ and $s_1(\phi)=s_1(3\cdot\alpha)$ and is also shown in FIG. 10.

Because of the triple rate of rotation of the disk 59 ($\phi=3\alpha$), the second eccentric pin 60 in combination with the rocker 55 and the push rod 58 produces a supplemental, periodic component of movement for the feeding slide whose frequency is three times the frequency of the principal component of movement, also periodical, which originates in the eccentric pin 52. FIG. 9 is based on the same direction of rotation of the disks 51, 59 or of their eccentric pins 52, 60. It is evident that the same displacement curves as in FIG. 10 result from opposite directions of rotation if the zero position of the second eccentric pin 60 shown in FIG. 9 is turned by $\phi=180°$.

In the absence of the above conditions as to the ratio of connecting rod length to eccentricity E, or rocker length and push rod length to the eccentricity Z, there are obtained displacement curves which deviate more or less from the sinusoidal shapes shown in FIG. 10 without basic change in the superimposition of components of movement and the resulting displacement curve. The invention also is not limited in any way to the case of the conditions assumed for simplified explanation. The movement of the axis A in a circular arc about the pivot axis of the joint 56 causes an angular velocity of the spur gear 54 and therewith of the eccentric pin 52 which periodically varies about a middle value, but which may be neglected for practical purposes.

As explained with reference to FIG. 1, the movement of the feeding slide is limited to the stroke h by means of abutments. Because of the superposition of a principal component of movement and a supplemental component of movement of triple frequency according to the invention, the relatively small feeding angle $\alpha_e$ and the return angle $\alpha_r$ of equal size entered in FIGS. 9 and 10 are needed as angles of revolution of the first eccentric pin 52 for the feeding slide stroke h. Because the displacement curves are shown in the range $0° \leqq \alpha \leqq 180°$, again only one half feeding angle $(\alpha_2)/2$ and one half return angle $(\alpha_r)/2$ appear in FIG. 10. In order to permit the overrun $\ddot{u}_1$ evident from FIG. 10, that is, the continued movement of the connecting rod 53 after impingement of the feeding slide on an abutment, the connecting rod 53 is coupled to the feeding slide by springs in the manner described with reference to FIG. 1.

Comparison of the displacement curves $s(\alpha)$ and $s_2(\alpha)$ in FIG. 10 makes clear the influence of the supplemental component of movement according to the invention on the magnitude of the feeding angle and the overrun. Without the supplemental component of movement, the substantially greater overrun $\ddot{u}_2$ and a substantially greater feeding angle would result at equal stroke h. The greater feeding angle would entail a smaller stoppage angle $\alpha$'s and thereby a smaller working angle per machine cycle. When the ratio of the eccentricity E to the eccentricity Z is suitably selected, the velocity of impingement of the feeding slide on its abutments may be held reliably at least not greater than in a movement caused exclusively by the first eccentric pin at equal eccentricity E. This means that the supplemental component of movement substantially reduces both the overrun and also the impingement velocity at equal feeding angle.

As is seen from FIG. 10, the greatest possible feeding length, that is, the greatest possible slide stroke $h_{max} = 2 \cdot (E-Z)$ is obtained with the resulting displacement curve $s_2(\alpha)$. If the feeding slide stroke were set for an even greater value by means of the abutments, the feeding slide would again lift from the abutment at $\alpha = 90°$ which, of course, is undesirable. A maximum feeding angle $\alpha_{emax} = 2 \cdot \arcsin(\frac{1}{2}) \cdot (\sqrt{E/z} - 1)$ corresponds to the maximum feed length. The greatest possible feeding angle thus depends on the ratio of the eccentricities of the first and second eccentric pin. If this ratio E/Z is between four and nine, the resulting displacement curve, when utilizing the maximum possible feeding angle, results in a reduction of overrun, a reduction of the feeding angle, and also a reduction of the velocity of impingement of the feeding slide against the abutments as compared to the pure sine curve of amplitude E and equal feeding slide stroke h. The ratio $E/Z = 9$ is a limiting value for which the resulting displacement curve $s_2(\alpha)$ has only a single maximum left at $\alpha = 90°$.

The explanation of the fourth embodiment of the invention so far was based in an assumed ratio of rotary speeds of the disk 51 and the disk 59 $n_1 : n_2 = 1:3$. As a matter of principle, the invention may also be realized at a ratio of rotary speeds $n_1 : n_2 = 1:5$ at which the supplemental component of movement has five times the frequency of the principal component of movement due to the eccentric pin 52. As compared to a movement due solely to the principal component of movement, this case does not yield a reduction of overrun at equal feeding angle, but a very substantial reduction in the velocity of impingement of the feeding slide against its abutments. It is also possible to provide a displacement curve for the feeding slide composed of three components of movement by means of a second eccentric pin revolving at three times the rate of revolution and a third pin revolving at five times the rate of revolution in which case the overrun could be reduced further as compared to the case explained with reference to FIG. 10 regardless of the very small feeding angle. Such a superposition of three components of movement could be realized by means of a cascade arrangement of the type of embodiment illustrated in FIG. 9. In such a cascade arrangement, the disk 59 would be journaled in a rocker comparable to the rocker 55, and this further rocker would be moved back and forth by a third disk having a third eccentric pin.

It was already indicated initially that the transmission of movement from the first eccentric pin 52 to the non-illustrated feeding slide need not necessarily be brought about by means of a connecting rod 53 or the like, but also, by way of example, by direct engagement of the eccentric pin in a suitable guide groove of the feeding slide. The same of course holds for the transmission of movement from the second eccentric pin 60 to the axis of rotation A of the disk 51 or the eccentric pin 52. The disk 51, for example, could be arranged on a slide which is guided in a straight line in the direction of the axis X-X similarly to the feeding slide. The supplemental component could be transmitted from the second eccentric pin 60 to such a slide by means of the push rod 58 or by direct engagement of the eccentric pin 60 in a guide groove in this slide. In the latter case, the sine course of the displacement curves represented in FIG. 10 would result exactly.

FIG. 11 schematically and in section illustrates a fifth embodiment of the invention in which the supplemental component of movement, preferably at three times the frequency of the principal component of movement, causes a periodic displacement of the axis A of revolution of the first eccentric pin as in the embodiment of FIG. 9. According to FIG. 11, the first eccentric pin 52' is arranged on a slide 61 whose position on a disc 51' is adjustable for setting the eccentricity E. The slide 61 is guided in a groove or guideway 63 on the disk 51'. The disk 51' is fastened on the end of a shaft 64 which is journaled in a first eccentric bushing 66 by means of bearings 65. The first eccentric bushing in turn is set in the bore of a second eccentric bushing 67. The external diameter of the eccentric pushing 66 is matched to the internal diameter of the eccentric bushing 67. The internal bores of both eccentric bushings are arranged eccentrically so as to result in a wall thickness varying along the circumference. The second eccentric bushing 67 is journaled in a stationary machine or frame portion 69 by means of bearings 68. The eccentricity Z, that is, the spacing between the axis A of rotation of the shaft 64 and the central axis D of the bore in the frame portion 69 receiving the bearings 68 and the eccentric bushing 67 depends on the relative angular position of the two eccentric bushings. This eccentricity Z, therefore, may be adjusted by turning the eccentric bushings relative to each other and arresting them relative to each other in certain angular positions by means of screws 70, for example, or in another suitable manner in any desired angular position.

Furthermore, a shaft 72 is journaled in the frame portion 69 by means of bearings 71 and carries at its two ends respective spur gears 73, 74. The spur gear 74 meshes with a gear rim 75 formed on the circumference of the second eccentric bushing 67. The spur gear 73 meshes with a pinion 77 fastened on the shaft 64 by means of an intermediate wheel 76. The intermediate wheel 76 is fastened to an articulated brace 78 which causes the intermediate wheel to mesh always both with the spur gear 73 and the pinion 77 regardless of the periodically varying spacing of the axis A of rotation of the shaft 64 and the axic C of rotation of the shaft 72. FIG. 12 shows the arrangement of spur gear 73, intermediate wheel 76, and pinion 77 in a schematic top view. The brace 78 not shown in detail in FIG. 11 is indicated in FIG. 12 by the two links 78. Motion, of course, could be transmitted between the spur gear 73 and the pinion 77 in another manner, for example, by means of a chain and a tensioning wheel or the like.

The transmission ratio of the gears 73 to 77 is selected to result in the desired ratio, particularly 3:1, of the rotary speed of the eccentric bushings 66, 67 constituting the second eccentric pin about the axis D of rotation and the rotary speed of the shaft 64 about the axis A of rotation.

When the spur gear 73 or the spur gear 74 is driven in a non-illustrated suitable manner by the machine drive, the eccentric bushings 66, 67 are caused by the gear rim 75 to rotate jointly about the axis of rotation D. The axis of rotation A of the shaft 64 therefore defines a circle of radius Z about the axis of rotation D. The shaft 64 itself is also caused to rotate by the wheels 73, 76, and 77 and turns the disk 51' with the eccentric pin 52'. The resulting drive movement for a feeding slide may again be taken off the eccentric pin 52' by means of a connecting rod or in a different manner.

A further embodiment of the invention with superposition of two components of movement is schematically shown in FIG. 13. A lever 82 is hinged to the feeding slide 80 guided in a straight line along the axis X-X whose stroke is limited by two adjustable adjustments 81. A disk 83 driven in synchronism with the machine carries a first eccentric pin 84 of optionally adjustable eccentricity E. A second disk 85 carries a second eccentric pin 86 of optionally adjustable eccentricity Z. The disk 85 may be rotated, for example, by means of the sprocket chain 87, 88, 89 synchronously, but at higher rotary speed, and preferably triple the rotary speed of the disk 83. The first eccentric pin 84 is connected by a first push rod 90 whose two ends are rotatably mounted with the lever 82. A push rod 91 similarly connects the second eccentric pin 86 with the lever 82. The respective connecting pivots 92, 93 of the push rods 90, 91 with the lever 82 are spaced from each other and from the point of pivoting connection of the lever on the feeding slide. Force is transmitted from the push rod 90 to the lever 82 in both directions by springs 94 which absorb the overrun explained with reference to FIG. 10.

Both embodiments according to FIGS. 11 and 12 and FIG. 13 at the corresponding 3:1 ratio of rotary speeds basically provide the same displacement curve $s_2(\alpha)$ of the feeding slide as illustrated in FIG. 10 and explained for the embodiment of FIG. 9. In the arrangement of FIG. 13, the ratio of the amplitudes of a principal component of movement ($\alpha$) and a supplemental component of movement $s_1(3\alpha)$ is determined not alone by a corresponding ratio of the eccentricities E, Z, but also by the transmission ratio of the lever 82, that is, by the spacings u and v. This spacing ratio u:v may be made variable in a suitable manner for influencing the displacement curves.

Whereas the principal component of movement and the supplemental component of movement are superimposed in the embodiments of FIGS. 9 and 11 already at the respective disks 51, 51', the two eccentric pins 84, 86 in the case of FIG. 12 are entirely separated from each other. The superposition of the two components of movement occurs only in a separate intermediate element, namely the lever 82.

Additional embodiments of the invention are described below and the superposition of the principal component of movement and the supplemental component of movement in these movements occurs directly at the first eccentric pin.

FIG. 14 is a schematic, sectional illustration of such an embodiment of the invention. A drive flange 96 is fixedly set in a machine or frame portion 95. A shaft 98 is journaled in the drive flange 96 by means of bearings 97. The upper end of the shaft 98 carries a plate 99, and the latter in turn carries a disk 100. For a reason to be explained later, the disk 100 may be turned relative to the plate 99 coaxially with the axis of rotation A and may be arrested, for example by means of screws 101 or otherwise in predetermined or arbitrary angular positions relative to the plate 99. The lower end of the shaft 98 is splined to a pinion 102 which is connected to a machine drive in a non-illustrated manner in such a manner that the shaft 98 makes one revolution per cycle time of the machine. A slide 103 is guided in the disk 100 and carries an eccentric pin 104. The position of the slide 103 is guided in the disk 100 and thereby the eccentricity of the eccentric pin 104 may be adjusted in the usual manner by means of a spindle 105. A gear 107 is pivoted coaxially on the eccentric pin 104 by means of bearings 106. A first, inner eccentric bushing 108 is fastened on the gear 107 and has a bore coaxial with the eccentric pin 104 and a circular circumference eccentric relative to the bore. A second, outer eccentric bushing 109 is fitted on the circumference of the first bushing. The two eccentric bushings 108, 109 may be turned relative to each other for adjusting the eccentricity Z and may be arrested in their relative angular position, for example, by means of screws 110. The head of a connecting rod 111 is set on the outer circumference of the second eccentric bushing 109 which transmits the resulting drive movement to a non-illustrated feeding slide. Here too, motion may be transmitted from the second eccentric bushing to the feeding slide otherwise than by means of a connecting rod. A pin 112 secures the entire arrangement axially on the eccentric pin 104.

A shaft 113 is journed in a bearing eye 115 of a link 116 by means of bearings 114. The two ends of the shaft 113 carry respective spur gears 117, 118. The spur gear 117 meshes with the gear 107 whereas the spur gear 118 is in engagement with a gear rim 119 formed at the circumference of the drive flange 96 and therefor stationary. A bore of the link 116 is set on the eccentric pin 104 and thereby pivotable about the latter. The bearing eye 115 of the link 116 is guided coaxially to the axis of rotation A in aligned, circularly arcuate slots in the plate 99 and the disk 100.

FIG. 15 permits the relative position of the essential drive elements in the embodiment of FIG. 14 to be seen in schematic top plan view.

When the shaft 98, driven by the pinion 102, turns and performs one revolution per cycle time of the machine, the disk 100 rotates correspondingly. Thus, the eccentric pin 104 and the shaft 113 with their spur gears 117, 118 perform a full revolution about the axis of rotation A during one cycle time while the respective central axes F, H of the eccentric pin 104 and the shaft 113 move in concentric circles. Because the gear rim 119 is stationary, the spur gear 118 rolls on the gear rim 119 so that the shaft 113 turns simultaneously about its axis H. The associated rotation of the spur gear 117 is transmitted to the gear 107. The gear 107, therefore, rotates about its axis of rotation which coincides with the axis F of the eccentric pin 104. With the rotation of the gear 107, the eccentric bushings 108, 109 also turn about the axis F as axis of rotation. The number of revolutions of the eccentric bushings per revolution of the eccentric pin 104 is readily adjusted by means of the transmission ratios of the several gears. The center G of the outer circumference of the outer eccentric bushing 109 turns continuously about the axis F whereas the latter travels on a circle about the axis of rotation A. The eccentric bushings 108, 109 in this case constitute the second eccentric pin from which the resulting movement may already be taken off.

If the eccentricity E of the eccentric pin 104 is adjusted, the shaft 113 is shifted because of the guidance by the slot 120 in the disk 100 and plate 99 on the one hand, and because of the guidance by the link 116 on the other hand in such a manner that the engagement of the wheels 117, 107 and 118, 119 is always ensured independently from the eccentricity E. The eccentricity Z, that is, the amplitude of the supplemental component of movement may be varied, as already indicated, by turning the two eccentric bushings relative to each other.

In the embodiment of the invention illustrated in FIGS. 14 and 15, the direction of the eccentric pin revolution about the axis of rotation A is opposite to the direction of rotation of the eccentric bushings on the eccentric pin. In order that the supplemental component of movement have triple the frequency of the principal component of movement the rate of rotation of the eccentric bushings 108, 109 must be four times that of the disk 100. With a suitably shaped drive flange 96, the spur gear 118 may mesh instead of the external teeth 119 also with a comparable internally toothed gear (not shown). This would lead to the same direction of rotation of the eccentric pin and the eccentric bushings. For a supplemental component of movement with triple frequency of the principal component of movement, a rotary speed of the eccentric bushings twice that of the disk 100 would be required. In both cases again the displacement curve $s_2(\alpha)$ for the feeding slide illustrated in FIG. 10 would result. The first alternative with opposite directions of rotation results in smaller deflection of the connecting rod head in a direction perpendicular to the direction of movement of the feeding slide and may therefore be preferable under certain conditions.

The relative rotatability of the disk 100 and the plate 99 permits the angular position of the eccentric pin 104 about the axis of rotation A to be adjusted at a reference time, for example, at the start of a cycle time.

FIGS. 16 and 17 show a further embodiment of the invention which differs from the embodiment of FIGS. 14 and 15 only by the drive for the two eccentric bushings again journaled coaxially to the eccentric pin. Identical elements are designated in this embodiment by the same reference characters as in the preceding one, and the description is limited to the differences.

The slide 103 with the eccentric pin 104 is adjustable on the disk 100 for adjustment of the eccentricity E of the pin relative to the axis of rotation A of the disk 100. As in the previous embodiment, the gear 107 and the eccentric bushings 108, 109 are arranged on the eccentric pin 104. The connecting rod 111 is set on the outer eccentric bushing 109. The inner eccentric bushing 108 has a circumferential section 121 concentric with the axis F on which an internally toothed gear 123 is freely rotatably mounted by means of a bearing 122. An intermediate wheel 125 is mounted freely rotatably on the slide 103 about an axis of rotation K at a distance from the eccentric pin 104 by means of a pin 124. The intermediate wheel 125 meshes both with the internal teeth 123' of the internally toothed gear 123 and the gear 107. A radial extension 126 of the gear 123 holds a pin 127 which is rotatable in the extension 126 about an axis parallel to the axes F, G, and K. The head of the pin 127 is shaped as a sleeve 128 in which the connecting rod 111 is slidably guided.

FIG. 17 shows the embodiment of FIG. 16 in schematic top view. If it is assumed initially that the length of the connecting rod 111 is great compared to the eccentricity E of the eccentric pin 104, one may start in first approximation from the assumption that the connecting rod 111 is shifted always parallel to itself during a revolution of the eccentric pin 104 about the axis of rotation A and the revolution of the eccentric bushings 108, 109 about the axis of rotation G. This means that the position of the gear 123 having internal teeth 123' relative to the axis F of the eccentric pin 104 remains unchanged during revolution of the pin about the axis of rotation A because relative angular movement of the connecting rod 111 and gear 123 is not possible. When the disk 100 turns synchronously with the machine, the axis F of the eccentric pin and the axis K of the intermediate wheel 125 move in concentric circles about the axis of rotation A. Because the gear 123 does not turn about the axis F under the conditions mentioned, the intermediate wheel rolls on the internal teeth 123' and thus performs additionally a rotation about its axis K. The rotation of the intermediate wheel 125 is transmitted to the gear 107 and leads to rotation of the eccentric bushings 108, 109 about the axis G. The desired ratio of rotary speeds between the eccentric bushings 108, 109 and the disk 100 may be set in the same manner as in the preceding embodiments by suitable selection of the transmission ratios of the gears 123, 125, and 107.

With finite length of the connecting rod 111, the latter swings back and forth about its point of pivoting attachment to the non-illustrated feeding slide which is associated with a corresponding back-and-forth swinging movement of the gear 123 about the axis F. The circle 129 in FIG. 18 represents the path of the eccentric pin 104 about the axis of rotation A. The straight lines 130 and 130' represent the extreme positions of the connecting rod swinging about the joint 131. When the eccentric pin 104 moves clockwise in its path 129, the rotation of the eccentric bushings 108, 109 is accelerated in the first and second quadrants (FIG. 18) because of the swinging movement of the connecting rod 111 as compared to a middle value corresponding to the infinite length of the connecting rod, whereas the rotation is braked in the third and fourth quadrants relative to that middle value. The rotation of the eccentric bushings thus takes place at a periodically varying angular velocity which may be neglected at the practically considered conditions of length or eccentricity.

We claim:

1. In a device for feeding stock to machines or devices having a feeding slide reciprocable in a straight line between two terminal positions and a driving device for the feeding slide including a first eccentric pin eccentrically revolving about an axis of revolution and temporarily leaving the feeding slide stationary in its two terminal positions during continued revolution of the eccentric pin, the improvement comprising an auxiliary device initiating periodic movement of the feeding slide which is superposed on the movement caused by revolution of the eccentric pin at least in the region of the terminal positions of the feeding slide, the auxiliary device including a second eccentric pin revolving about a second axis of revolution at a higher rate of revolution than said first eccentric pin.

2. A device according to claim 1 further comprising means for adjusting the eccentricity of at least one of the first and the second eccentric pins.

3. A device according to claim 1 wherein the first eccentric pin is arranged eccentrically on a disk which is journaled rotatably in an element reciprocated by the second eccentric pin in the direction of movement of the feeding slide.

4. A device according to claim 3 wherein the element is a rocker rotatably supported in a stationary link, the rocker being connected with the second eccentric pin in the manner of a sliding pin drive.

5. A device according to claim 4 wherein a drive wheel is arranged concentrically with the link in engagement with a driven wheel which is a part of the disk or connected with the same.

6. A device according to claim 3 wherein the element is a slide guided in a straight path.

7. A device according to claim 3 wherein the second eccentric pin constitutes the element.

8. A device according to claim 7 wherein the second eccentric pin includes an eccentric bushing rotatable in a stationary frame portion, with a driven shaft being journaled in the eccentric bore of the bushing.

9. A device according to claim 8 wherein the second eccentric pin is constituted by two eccentric bushings fitted one into the other which are capable of being turned and fixed relative to each other for adjustment of eccentricity.

10. A device according to claim 1 further comprising a lever hinged to the feeding slide and having spaced portions coupled to the two eccentric pins respectively.

11. A device according to claim 10 wherein at least one of the eccentric pins is connected with the lever by a pusher rod hingedly attached at both ends.

12. A device according to claim 10 wherein at least one of the eccentric pins engages a driving recess in the lever in rotatable and longitudinally adjustable engagement.

13. A device according to claim 1 wherein the rate of revolution of the second eccentric pin is three times that of the first eccentric pin.

14. A device according to claim 1 wherein the second eccentric pin is arranged on the first eccentric pin and revolves in the same direction and at twice the rate of the latter.

15. A device according to claim 1 wherein the second eccentric pin is arranged on the first eccentric pin and revolves in the opposite direction at four times the rate of the latter.

16. A device according to claim 1 or 14 wherein the second eccentric pin includes a freely rotatable eccentric bushing journaled coaxially with the first eccentric pin.

17. A device according to claim 16 wherein the second eccentric pin is constituted by two eccentric bushings fitted one into the other and rotatable and fastenable relative to each other for adjustment of the eccentricity, the outer eccentric bushing being connected with the feeding slide directly or by a coupling element.

18. A device according to claim 16 further comprising a first gear connected with the eccentric bushing and mounted coaxially with the first eccentric pin, and a link having one end pivotally journaled on the first eccentric pin and another end constituting a bearing ear for a countershaft and guided movably in a circular arc concentric with the axis of revolution of the first eccentric pin, the ends of the countershaft carrying a second and third gear respectively, the second gear meshing with the first gear, whereas the third gear meshes with a stationary fourth gear.

19. A device according to claim 18 wherein the fourth gear is constituted by a gear rim on a drive flange for a drive shaft, the flange being fastened in the stationary frame, the shaft being connected with a disk carrying the first eccentric pin.

20. A device according to claim 18 wherein the bearing ear of the link is guided in a slot in the disk which is concentric with the drive shaft and of circularly arcuate shape.

21. A device according to claim 18 wherein the fourth gear is an externally toothed gear.

22. A device according to claim 16 wherein the coupling element is a connecting rod, wherein an internally toothed first gear is journaled for free rotation coaxially on the first eccentric pin, wherein a pin is rotatably arranged in the gear and carries a bushing slidably engaging the connecting rod, wherein a second gear is freely rotatably mounted coaxially with the first eccentric pin and is connected with one of the eccentric bushings of the second eccentric pin, and wherein a third gear is rotatably secured on a disk carrying the first eccentric pin or on a slide carrying the eccentric pin, the third gear meshing both with the first and the second gear.

23. A device according to claim 1 wherein the ratio of the eccentricity of the first eccentric pin to the eccentricity of the second eccentric pin is smaller than 9:1.

24. Feed apparatus for the infeed of material in machines or apparatus, comprising a driving shaft rotatable about a drive axis, a first eccentric part which rotates with said driving shaft and has a first eccentric part axis which is displaced parallel relative to said drive axis and a second eccentric part which follows the movement of the first eccentric part about said drive axis, with a second eccentric part axis which is displaced parallel relative to the first eccentric part axis, this second eccentric part being rotatable about a second-eccentric-part-turning-axis parallel to said second-eccentric-part axis and receiving, by way of a train of gear wheels stepped-up rotary movement derived from the rotation of said driving shaft, the drive movement for the feed apparatus being taken from the second eccentric part, the apparatus further comprising a gear wheel carrier following the movements of the first eccentric part about the drive axis, the spatial orientation of said gear wheel carrier being substantially constant and said gear wheel carrier carrying a gear wheel which lies in the train of gear wheels.

25. Apparatus as claimed in claim 24, wherein the second eccentric part is rotatable about its second eccentric-part-turning-axis at a speed which corresponds to an odd integral multiple of the speed of the driving shaft.

26. Apparatus as claimed in claim 25, wherein the odd integral multiple is 3.

27. Apparatus as claimed in claims 24, 25 or 26 wherein the eccentricity of the first eccentric part relative to the drive axis is variable.

28. Apparatus as claimed in claim 27, wherein the first eccentric part is arranged on a first eccentric part carrier which is shiftable relative to the drive axis.

29. Apparatus as claimed in claims 24, 25 or 26 wherein the first eccentric part is an eccentric pin, which constitutes an axially parallel continuation of the driving shaft.

30. Apparatus as claimed in claims 24, 25 or 26, wherein the eccentricity of the second eccentric part relative to its second-eccentric-part-turning-axis is variable.

31. Apparatus as claimed in claim 30, wherein the second eccentric part consists of an eccentric base member and of an eccentric structure member, which can be rotated relative to the eccentric base member and locked in the position arrived at after rotation.

32. Apparatus as claimed in claim 31, wherein said eccentric base member is rotatable about a driving gear wheel, which is concentric with the second-eccentric-part-turning-axis and can be locked in the position arrived at after rotation.

33. Apparatus as claimed in claims 24, 25 or 26 wherein the spatial orientation of the gear wheel carrier is substantially constant through support on a connecting rod which serves as drive organ and is rotatably mounted on the second eccentric part.

34. Apparatus as claimed in claim 33, wherein the gear wheel carrier is supported on the connecting rod (111) by a supporting device which permits a sliding- and rotary-movement.

35. Apparatus as claimed in claims 24, 25 or 26, wherein the second eccentric part is rotatably mounted on the first eccentric part about the first eccentric part axis of said first eccentric part (104); and a gear wheel which is attached to and for rotation with the second eccentric part, and is located concentrically of the first eccentric part axis of the first eccentric part, is in rolling engagement with an internally toothed rim secured to the gear wheel carrier, the gear wheel carrier being rotatably mounted on the second eccentric part.

36. Apparatus as claimed in claim 35, wherein the driving gear wheel which is rotatable with the second eccentric part is in engagement, by way of an intermediate gear wheel, with the internally toothed rim of the gear wheel carrier, this intermediate gear wheel being mounted about an intermediate gear wheel axis which is stationary relative to the first eccentric part axis.

* * * * *